US011612915B2

(12) United States Patent
Suzuki

(10) Patent No.: US 11,612,915 B2
(45) Date of Patent: Mar. 28, 2023

(54) CLEANING METHOD AND CLEANING APPARATUS

(71) Applicant: EBARA CORPORATION, Tokyo (JP)

(72) Inventor: Kiyoshi Suzuki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 242 days.

(21) Appl. No.: 17/166,399

(22) Filed: Feb. 3, 2021

(65) Prior Publication Data

US 2021/0260630 A1 Aug. 26, 2021

(30) Foreign Application Priority Data

Feb. 25, 2020 (JP) ..... JP2020-029646

(51) Int. Cl.

| | |
|---|---|
| ***B08B 3/04*** | (2006.01) |
| ***C25D 17/06*** | (2006.01) |
| ***C25D 17/10*** | (2006.01) |
| ***B08B 11/02*** | (2006.01) |
| ***B08B 3/02*** | (2006.01) |
| ***B08B 1/04*** | (2006.01) |
| ***C25D 21/00*** | (2006.01) |
| ***C11D 7/26*** | (2006.01) |

(52) U.S. Cl.

CPC ..... *B08B 3/04* (2013.01); *B08B 1/04* (2013.01); *B08B 3/02* (2013.01); *B08B 11/02* (2013.01); *C11D 7/265* (2013.01); *C25D 17/06* (2013.01); *C25D 17/10* (2013.01); *C25D 21/00* (2013.01)

(58) Field of Classification Search

CPC ..... B08B 3/04

See application file for complete search history.

(56) References Cited

FOREIGN PATENT DOCUMENTS

JP 2005-139558 A 6/2005

*Primary Examiner* — Jason Y Ko

(74) *Attorney, Agent, or Firm* — BakerHostetler

(57) ABSTRACT

There is provided a cleaning method and a cleaning apparatus capable of removing dirt on electrical contacts, the dirt being unable to be removed with deionized water, without adversely affecting a plating solution and a substrate holder which is a member for holding a substrate. A cleaning method according to the present disclosure is a cleaning method for a substrate holder having electrical contacts for supplying electric power to a substrate by contacting the substrate to plate the substrate, the method including a cleaning step of cleaning the electrical contacts attached to the substrate holder with a citric acid aqueous solution.

20 Claims, 11 Drawing Sheets

CLEANING METHOD AND CLEANING APPARATUS

CROSS-REFERENCE TO RELATED APPLICATION

This application is based upon and claims benefit of priority from Japanese Patent Application No. 2020-029646 filed on Feb. 25, 2020, the entire contents of which are incorporated herein by reference.

TECHNICAL FIELD

The present invention relates to a cleaning method, and a cleaning apparatus.

BACKGROUND ART

A plating apparatus is used to form a metal thin film on a surface of a substrate. For example, PTL 1 discloses a substrate plating apparatus that includes a substrate holder for attachably and detachably holding a substrate whose surface to be plated faces upward, a cathode portion including a cathode electrode and a sealing member, a movable electrode head including an anode, and a fixed nozzle. The substrate holder is configured to be capable of moving up and down among a lower substrate transfer position, an upper plating position, and a preprocessing and cleaning position positioned intermediately therebetween. When the substrate holder is positioned at the plating position, the cathode electrode contacts a circumferential edge of the substrate, and the anode is arranged at a position facing the substrate. The substrate plating apparatus performs a plating process by bringing an upper surface of the substrate into contact with a plating solution. When the substrate holder is positioned at the preprocessing and cleaning position, the fixed nozzle supplies deionized water to the cathode portion, and cleans the cathode electrode.

CITATION LIST

Patent Literature

PTL 1: Japanese Patent Laid-Open No. 2005-139558

SUMMARY OF INVENTION

Technical Problem

When the cathode electrode is used to plate the substrate, dirt may adhere to a contact surface of the cathode electrode with the substrate. When the dirt adheres to the cathode electrode, the dirt serves as resistance, which makes it impossible for the cathode electrode to apply an intended current to the substrate. As a result, the thickness of plating formed on the substrate may become non-uniform. On the other hand, the plating apparatus disclosed in PTL 1, as described above, cleans the cathode electrode with deionized water to remove the dirt on the cathode electrode, which prevents such a problem from occurring. However, various substances are contained in the dirt adhering to the cathode electrode, which may make it difficult to completely remove the dirt by cleaning with deionized water. For example, oxides on a copper seed layer and resist residues may be deposited on the substrate with which the cathode electrode is brought into contact. The copper oxides and the resist residues may adhere to the cathode electrode, and become the dirt. It may be impossible to sufficiently remove the copper oxides and the resist residues on the cathode electrode by cleaning with deionized water.

In the plating apparatus disclosed in PTL 1, when medical agents such as sulfuric acid, a sulfuric acid-hydrogen peroxide solution (mixed liquid of concentrated sulfuric acid and hydrogen peroxide water), and an aqueous solution containing ozone microbubbles are used instead of the deionized water, these medical agents make it possible to remove the dirt such as copper, copper oxides, and resists that cannot be removed with deionized water. However, these medical agents may adversely affect a member for holding the substrate, the member including a sealing member positioned in the vicinity of the cathode electrode. The member for holding the substrate is formed of a polyetheretherketone resin (PEEK), fluorine rubber (FKM), stainless steel, and the like. The sulfuric acid and the sulfuric acid-hydrogen peroxide solution have properties that may corrode metals, and the ozone microbubbles have properties that may degrade resin or rubber. Therefore, when the cathode electrode is cleaned with these medical agents without being separated from the member for holding the substrate, the above-described medical agents are applied to the member for holding the substrate, which may damage the member for holding the substrate.

In the event where the cathode electrode is cleaned with the sulfuric acid-hydrogen peroxide solution and then the sulfuric acid-hydrogen peroxide solution remains on a part of the member for holding the substrate, the remaining sulfuric acid-hydrogen peroxide solution is mixed into the plating solution when the next plating process is performed. In this case, the sulfuric acid-hydrogen peroxide solution destroys the electrolyte of the plating solution, which adversely affects the plating solution. Accordingly, selection of a chemical liquid for cleaning the cathode electrode is very important.

In view of the above-described problem, an object of the present disclosure is to provide a cleaning method and a cleaning apparatus capable of removing dirt on cathode electrodes (electrical contacts), the dirt being unable to be removed with deionized water, without adversely affecting a plating solution and a substrate holder which is a member for holding a substrate.

Solution to Problem

A cleaning method according to one embodiment is a method for a substrate holder that has electrical contacts for supplying electric power to a substrate by contacting the substrate to plate the substrate, the method including a cleaning step of cleaning the electrical contacts attached to the substrate holder with a citric acid aqueous solution.

A cleaning apparatus according to one embodiment includes a rotation member for holding a ring-shaped holding member that holds a substrate for plating and has electrical contacts brought into contact with the substrate, an actuator for rotating the rotation member to rotate the holding member in a circumferential direction, and a cleaning module for cleaning, with a citric acid aqueous solution, the holding member rotated by the rotation member.

A cleaning apparatus according to one embodiment is a cleaning apparatus for a holding member that has electrical contacts and is a member forming at least part of a substrate holder, the cleaning apparatus including a cleaning tank for holding a citric acid aqueous solution therein and immersing the holding member in the citric acid aqueous solution.

DESCRIPTION OF EMBODIMENTS

<<Overview>>

Figure 1:
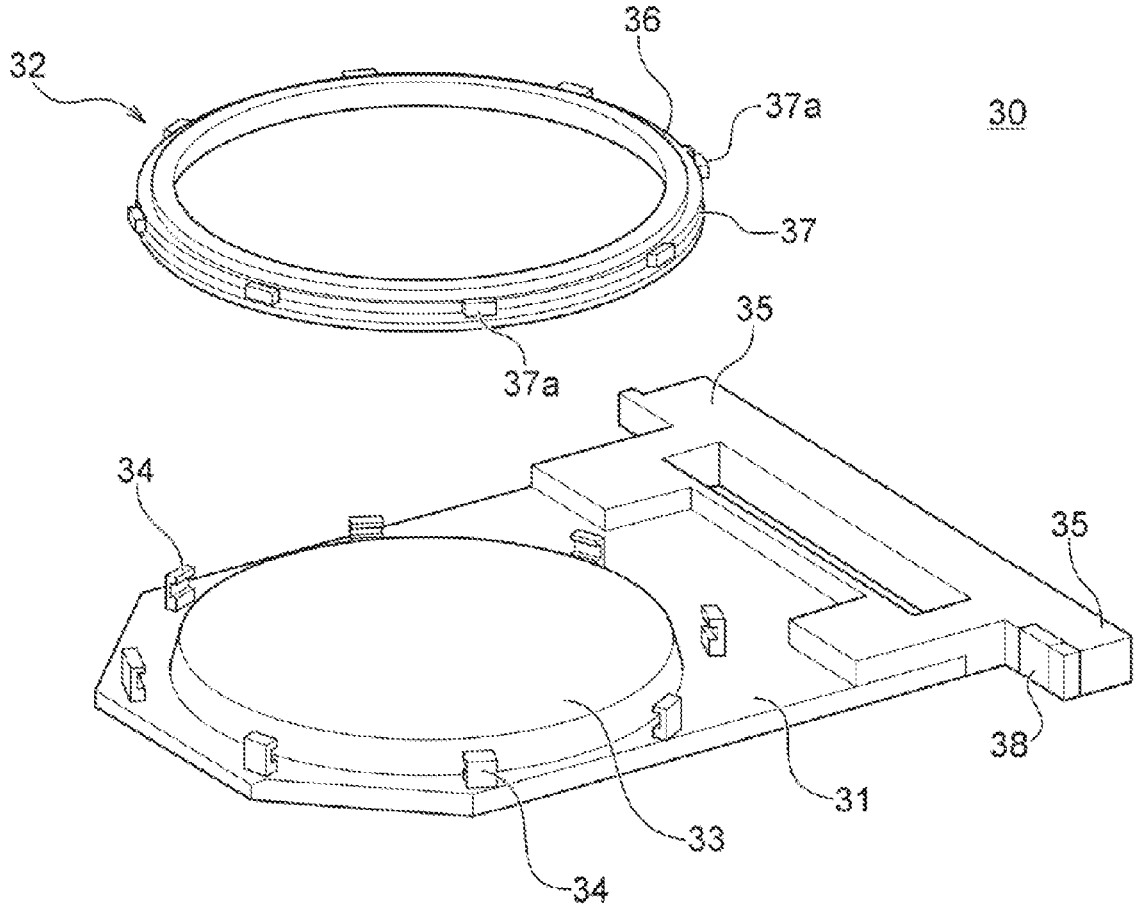
FIG. 1 is an exploded perspective view of a substrate holder.

Hereinafter, two embodiments (first and second embodiments) according to the present disclosure will be illustrated and described. Note that in the drawings described below, identical or corresponding components are denoted by the same reference numerals, and the duplicate description will be omitted.

First Embodiment

Hereinafter, a cleaning apparatus according to a first embodiment will be described with reference to the drawings. First, a configuration of a substrate holder 30 to be cleaned by a cleaning apparatus 100 will be described. Next, a configuration of the cleaning apparatus 100 according to the present embodiment will be described. Then, a cleaning method in the cleaning apparatus 100 will be described.

<Configuration of Substrate Holder>

FIG. 1 is an exploded perspective view of the substrate holder 30. As illustrated in FIG. 1, the substrate holder 30 includes, for example, a rectangular flat plate-shaped first holding member 31 made of vinyl chloride, and a ring-shaped second holding member 32 (corresponding to one example of a holding member) configured to be attachable to and detachable from the first holding member 31. This substrate holder 30 holds a substrate Wf such as a wafer by sandwiching the substrate Wf between the first holding member 31 and the second holding member 32 (see FIG. 2). Note that, in the present disclosure, the substrate holder refers to a device for holding the substrate Wf and a part of the device. That is, each of the first holding member 31 and the second holding member 32 may be also referred to as a substrate holder. A support surface 33 for supporting the substrate Wf is provided substantially in a central portion of the first holding member 31 of the substrate holder 30. Furthermore, a plurality of inverted L-shaped clampers 34 having inwardly protruding protrusions are provided at equal intervals along a circumference of the support surface 33, on an outer side of the support surface 33 of the first holding member 31.

A pair of handles 35 are connected to an end of the first holding member 31 of the substrate holder 30, the handles 35 serving as supporters in transporting or suspension-supporting the substrate holder 30. The substrate holder 30 is vertically suspension-supported, by hanging the handles 35 on an upper surface of a circumferential wall of each of various processing tanks in a substrate processing device (not illustrated), and the substrate Wf held by the substrate holder 30 is processed in the processing tank. For example, when the substrate holder 30 is hanged on an upper surface of a circumferential wall of a plating tank that holds a plating solution, the substrate Wf is immersed in the plating solution. In this state, a surface of the substrate Wf is plated. A transporter provided in the substrate processing device can grip the handles 35 and transport the substrate holder 30.

Additionally, one of the handles 35 is provided with an external contact 38 electrically connected to an external power source. When the substrate holder is hanged on the upper surface of the circumferential wall of the plating tank, the external contact 38 is brought into contact with a contact provided on the plating tank, the contact being electrically connected to the external power source, whereby the external contact 38 is electrically connected to the external power source. This external contact 38 is electrically connected to a plurality of relay contacts 60 (see FIG. 2) provided on an outer circumference of the support surface 33 via a plurality of conducting wires.

The second holding member 32 includes a ring-shaped seal holder 36 made of a polyether ether ketone resin (PEEK material). A pressure ring 37 for pressing and fixing the seal holder 36 to the first holding member 31 is rotatably attached to the seal holder 36 of the second holding member 32. The pressure ring 37 has a plurality of protrusions 37*a* that protrude outwardly in an outer circumferential portion of the pressure ring 37. An upper surface of each protrusion 37*a* and a lower surface of the inward protrusion of the clamper 34 have tapered surfaces that are inclined in mutually opposite directions along a rotational direction.

To hold the substrate Wf, first, the substrate Wf is mounted on the support surface 33 of the first holding member 31 in a state where the second holding member 32 is detached from the first holding member 31, and the second holding member 32 is attached to the first holding member 31. Subsequently, the pressure ring 37 is rotated clockwise, so that the protrusions 37*a* of the pressure ring 37 slip in (under) the inward protrusions of the clampers 34. Consequently, the first holding member 31 and the second holding member 32 are mutually clamped and locked via the tapered surfaces provided on the pressure ring 37 and the clampers 34, respectively, and the substrate Wf is held. To release the holding of the substrate Wf, the pressure ring 37 is rotated counterclockwise in a state where the first holding member 31 and the second holding member 32 are locked. Consequently, the protrusions 37*a* of the pressure ring 37 are disengaged from the inverted L-shaped clampers 34, thereby releasing the holding of the substrate Wf.

Figure 2:
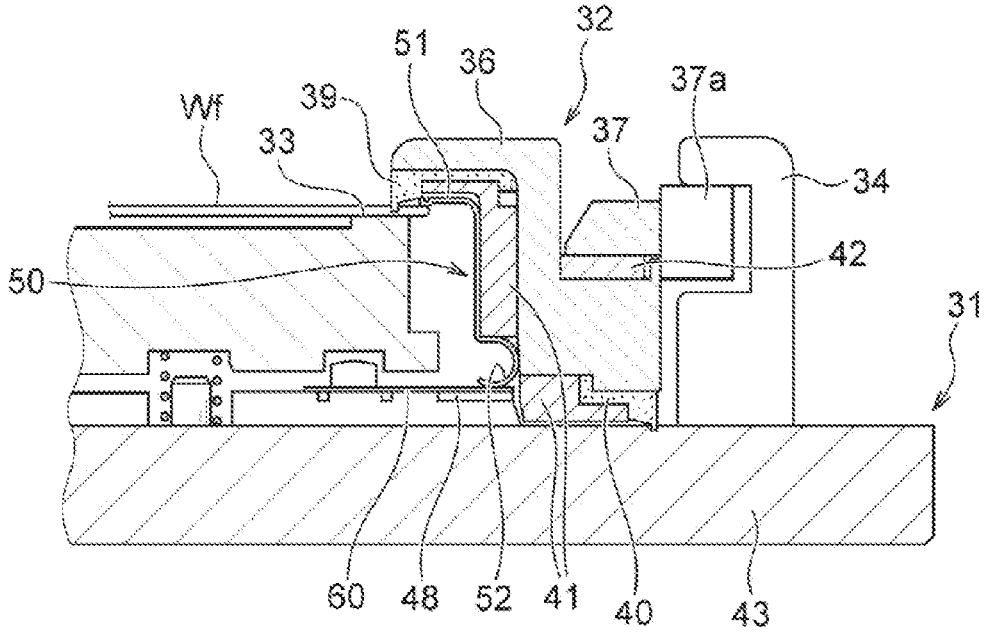
FIG. 2 is a partially enlarged cross-sectional view of the substrate holder illustrated in FIG. 1.

FIG. 2 is a partially enlarged cross-sectional view in a cross section in a thickness direction of the substrate holder 30 in a state where the substrate Wf is held. As illustrated in the figure, an inner seal 39 and an outer seal 40 are provided on surfaces facing the first holding member 31 of the seal holder 36 of the second holding member 32. Each of the inner seal 39 and the outer seal 40 is made of fluorine rubber. The inner seal 39 is configured to seal between a substrate Wf surface and the seal holder 36 by contacting an outer circumferential portion of the substrate Wf when the substrate Wf is held by the substrate holder 30. The outer seal 40 is provided more on an outer side in a radial direction than the inner seal 39, and is configured to contact a support base 43 of the first holding member 31. Consequently, the outer seal 40 can seal between the seal holder 36 and the support base 43. Each of the inner seal 39 and the outer seal 40 is attached to the seal holder 36 by being sandwiched between the seal holder 36 and a stainless-steel fixing ring 41 attached to the seal holder 36 via a fastener such as a bolt.

A step portion is provided on an outer circumferential portion of the seal holder 36 of the second holding member 32, and the pressure ring 37 is rotatably mounted, via a spacer 42, on this step portion. The pressure ring 37 is made of a metal (for example, titanium) having sufficient rigidity, with excellent corrosion resistance with respect to acid. The spacer 42 is made of a material having a low coefficient of friction, for example, PTFE (polytetrafluoroethylene), so that the pressure ring 37 can rotate smoothly.

The flat plate-shaped relay contacts 60 are provided on the support base 43 of the first holding member 31. One relay contact 60 is illustrated in FIG. 2. A plurality of relay contacts 60 are arranged on the support base 43, along the circumference of the support surface 33. The relay contacts 60 are electrically connected by conducting wires, which are not illustrated, to the external contact 38 illustrated in FIG. 1. The relay contacts 60 are fixed to the support base 43 by arbitrary fixing devices such as screws at one end sides thereof. Moreover, a step portion 48 is formed on the support base 43, so that the other end sides of the relay contacts 60 become free ends.

Figure 3:
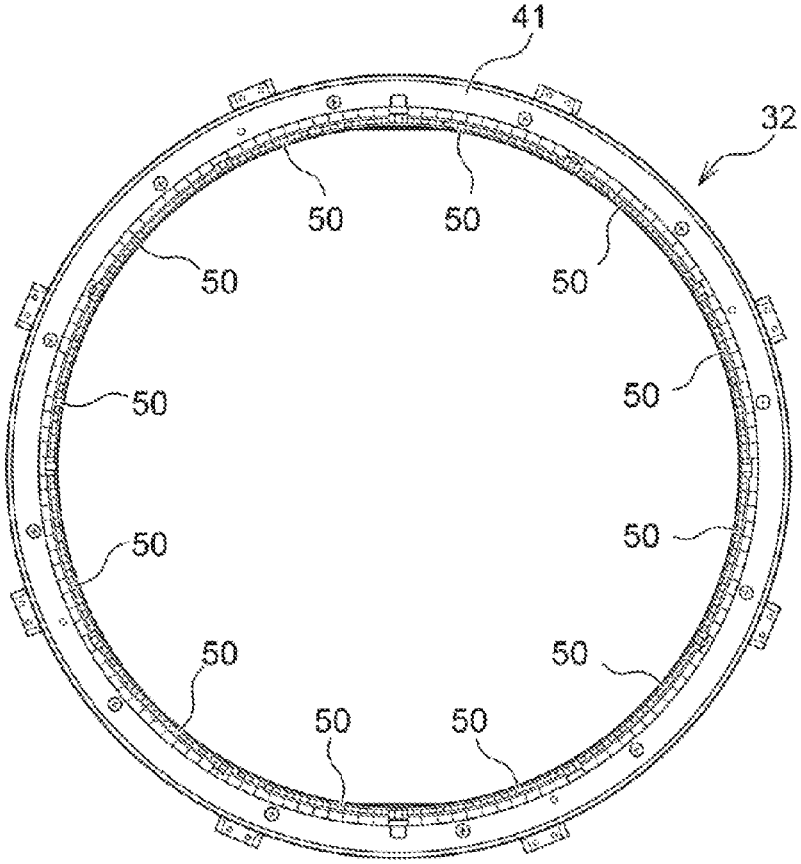
FIG. 3 is a rear view of a second holding member of the substrate holder illustrated in FIG. 1.

A plurality of electrical contacts 50 are attached to an inner circumferential surface of the fixing ring 41 of the second holding member 32, the electrical contacts 50 supplying electric power to the substrate Wf by contacting the outer circumferential portion of the substrate Wf supported by the support surface 33 when the substrate Wf is held by the substrate holder 30. The electrical contacts 50 supply the electric power to the substrate Wf while the substrate Wf is immersed in the plating solution, whereby the substrate Wf is plated. One electrical contact 50 is illustrated in FIG. 2. Reference will now be made to FIG. 3. FIG. 3 is a rear view of the second holding member 32 of the substrate holder 30. The plurality of electrical contacts 50 are attached across approximately the entire circumference of the fixing ring 41.

Referring again to FIG. 2, the electrical contacts 50 have a plurality of first ends 51 that are brought into contact with the substrate Wf, and a plurality of second ends 52 that are brought into contact with the relay contacts 60. Preferably, the electrical contacts 50 are formed from a spring material such as stainless steel, and surfaces thereof are gold-plated. The first ends 51 are configured to be bent at an angle of approximately 90° and protrude in a plate spring shape to the front side (the center side of the support surface 33). The first ends 51 are configured to elastically contact the outer circumferential portion of the substrate Wf when the substrate Wf is held by the substrate holder 30 as illustrated in FIG. 2.

As illustrated in FIG. 2, the second ends 52 of the electrical contacts 50 have an approximately C-shaped section in the cross section of the thickness direction of the substrate holder 30. Consequently, the second ends 52 of the electrical contacts 50 are configured to elastically contact the relay contacts 60 when the substrate Wf is held by the first holding member 31 and the second holding member 32.

<Configuration of Cleaning Apparatus>

Figure 4:
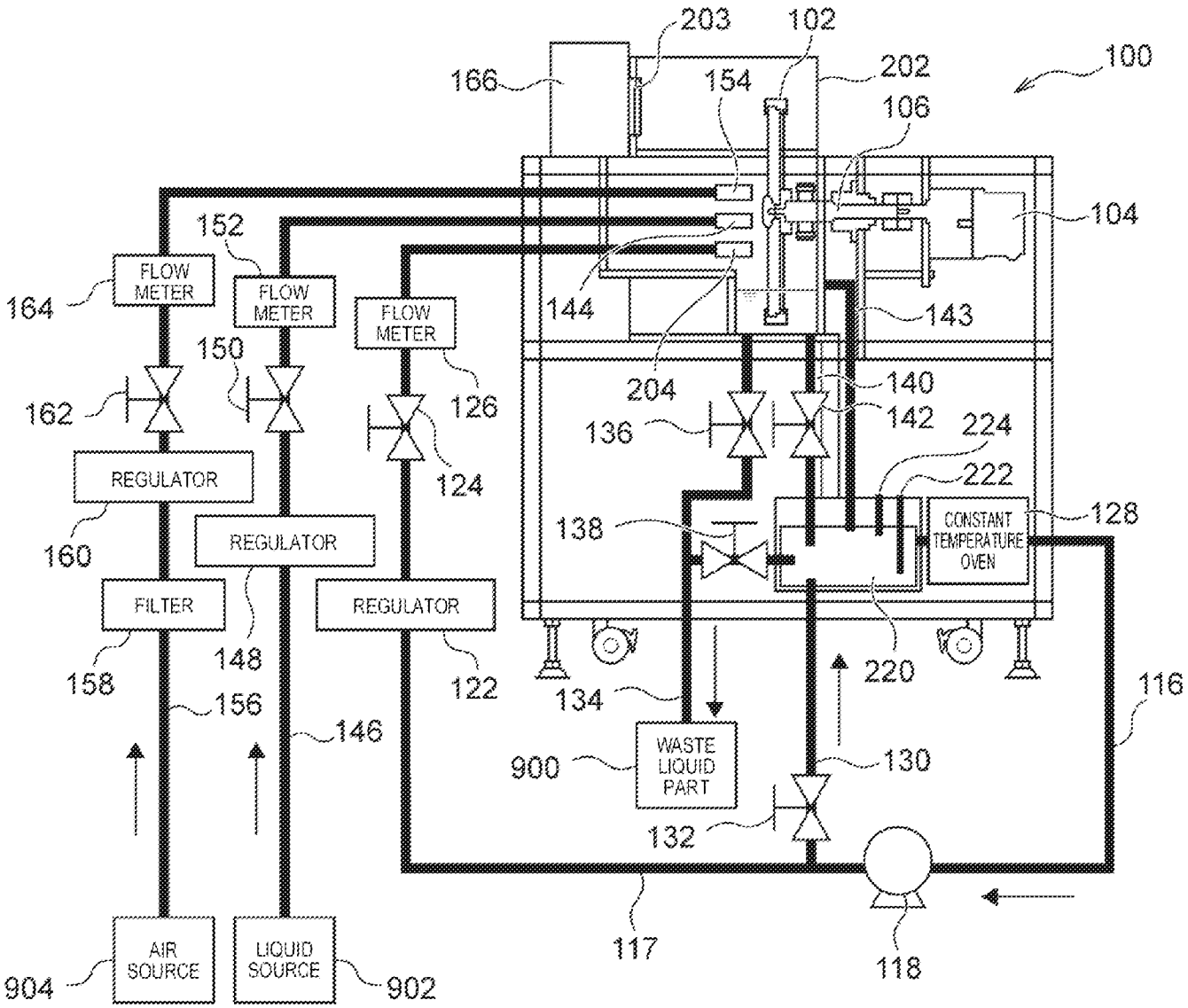
FIG. 4 is a diagram illustrating a cleaning apparatus according to the present disclosure.
Figure 5:
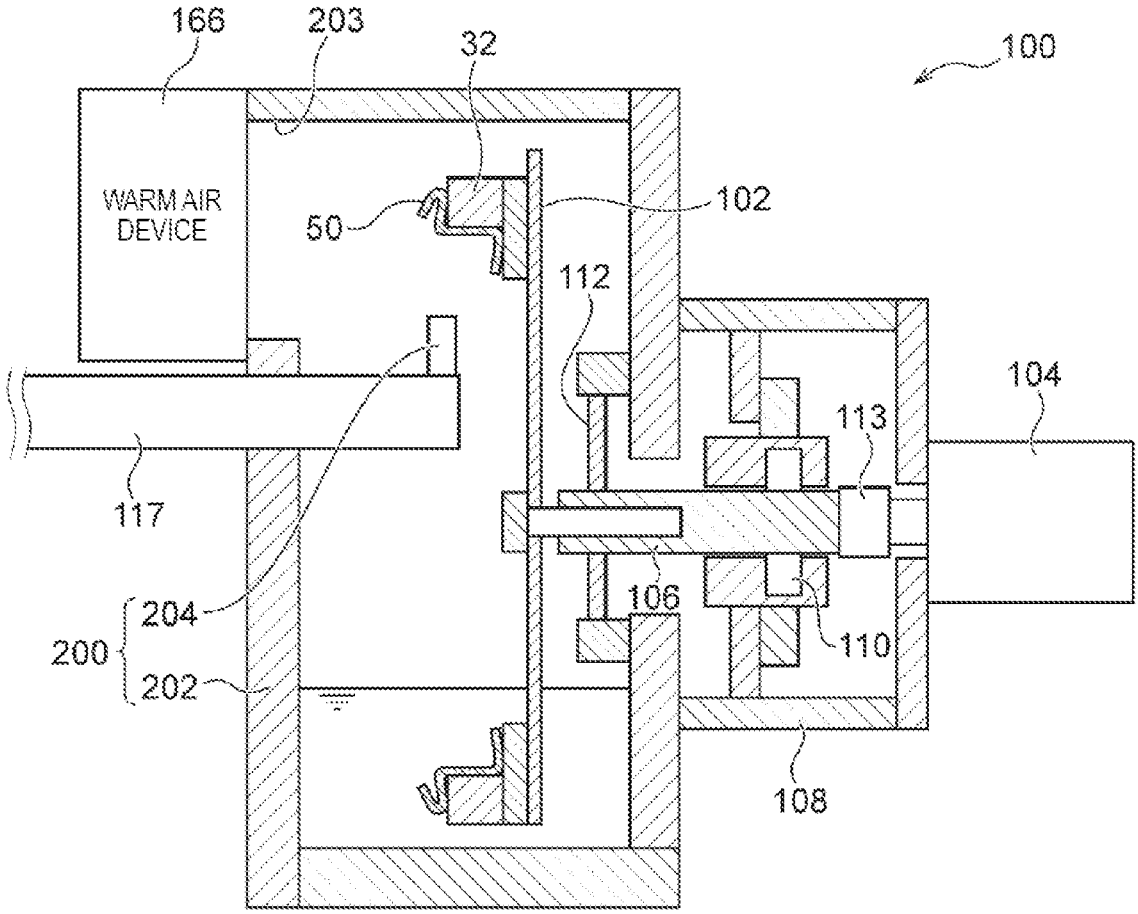
FIG. 5 is a schematic diagram illustrating an overview of a part of a case of the cleaning apparatus illustrated in FIG. 4.

FIG. 4 is a diagram illustrating the cleaning apparatus 100 according to the present disclosure. FIG. 5 is a schematic diagram illustrating an overview of a part of a case 202 of the cleaning apparatus 100. The cleaning apparatus 100 is an apparatus for cleaning the electrical contacts 50 of the substrate holder 30. Referring to FIG. 5, the cleaning apparatus 100 includes a rotation member 102, an actuator 104, a cleaning module 200, a rotation shaft 106, a frame 108, a bearing 110, packing 112, and a flexible coupling 113. Additionally, the cleaning module 200 includes the case 202. Hereinafter, each component of the cleaning apparatus 100 will be described.

The case 202 is configured to surround the rotation member 102, and has a function of holding therein a liquid such as a citric acid aqueous solution or water. Additionally, the rotation member 102 has a disk shape, as an example, and is positioned inside the case 202. The rotation member 102 has a function of holding the ring-shaped second holding member 32. A center of the rotation member 102 is fixed to the rotation shaft 106 extending outside the case 202. The rotation shaft 106 is rotatably supported on the bearing 110 attached to the frame 108 that is positioned outside the case 202. The actuator 104 is fixed to the frame 108, and is connected to the rotation shaft 106 via the flexible coupling 113. Consequently, the actuator 104 can rotate the rotation member 102, thereby rotating the second holding member 32 in a circumferential direction. Note that the actuator 104 is a waterproof brushless motor, as an example. Additionally, the packing 112 is provided between the rotation shaft 106 and the case 202, thereby preventing a liquid in the case 202 from leaking to the outside.

As illustrated in FIG. 5, the cleaning module 200 includes a nozzle 204, as an example. Additionally, as illustrated in FIG. 4, the cleaning apparatus 100 includes a citric acid tank 220, a pipe 116, a pipe 117, and a pump 118, as an example. The citric acid tank 220 has a function of holding a citric acid aqueous solution therein. In the present embodiment, the citric acid tank 220 holds the citric acid aqueous solution therein, and the percent concentration of mass of citric acid in the citric acid aqueous solution is 2 to 30%. The pipe 116 communicates the citric acid tank 220 with a suction port of the pump 118, and the pipe 117 communicates a discharge port of the pump 118 with the nozzle 204. Consequently, the pump 118 can pressure-feeds, to the nozzle 204, the citric acid aqueous solution held in the citric acid tank 220. A spray port of the nozzle 204 is directed toward the electrical contact 50 of the second holding member 32 held by the rotation member 102 (see FIG. 5). Therefore, the nozzle 204 can spray the citric acid aqueous solution on the electrical contact 50 of the second holding member 32, so that the electrical contact 50 can be cleaned with the citric acid aqueous solution.

The cleaning apparatus 100 includes, as an example, a regulator 122, a valve 124, and a flow meter 126, which are attached to the pipe 117. The regulator 122 has a function of reducing a pressure of the citric acid aqueous solution flowing in the pipe 117, and the flow meter 126 has a function of measuring a flow rate of the citric acid aqueous solution flowing in the pipe 117. The valve 124 has a function of adjusting the flow rate of the citric acid aqueous solution flowing in the pipe 117.

The cleaning apparatus 100 includes a constant temperature oven 128, a pipe 130, and a valve 132, as an example. The constant temperature oven 128 is attached to the pipe 116, and has a function of heating the citric acid aqueous solution flowing in the pipe 116. Additionally, the pipe 130 communicates the discharge port of the pump 118 with the citric acid tank 220. The valve 132 has a function of adjusting the flow rate of the citric acid aqueous solution flowing in the pipe 130. Consequently, in a case where the valve 132 is open when the pump 118 pressure-feeds the citric acid aqueous solution, the citric acid aqueous solution heated by the constant temperature oven 128 is returned to the citric acid tank 220, again. That is, the constant temperature oven 128 can heat the citric acid aqueous solution held in the citric acid tank 220 to a predetermined temperature. In particular, in the first embodiment, the constant temperature oven 128 heats the citric acid aqueous solution to a temperature of 35 to 55 degrees Celsius inclusive, as an example.

The cleaning apparatus 100 includes a pipe 134, a valve 136, and a valve 138, as an example. The pipe 134 communicates the case 202 and the citric acid tank 220 with a waste liquid part 900 of a factory. In other words, the pipe 134 forms a flow path from the case 202 to the waste liquid part 900 and a flow path from the citric acid tank 220 to the waste liquid part 900. Additionally, the valve 136 is attached to the pipe 134, and has a function of adjusting a flow rate of the liquid flowing from the case 202 to the waste liquid part 900. Consequently, when the valve 136 is opened, the cleaning apparatus 100 can discard into the waste liquid part 900, the liquid that is no longer necessary in the case 202. On the other hand, the valve 138 is attached to the pipe 134, and has a function of adjusting an amount of the liquid flowing from the citric acid tank 220 to the waste liquid part 900. Consequently, when the valve 138 is opened, the cleaning apparatus 100 can discard into the waste liquid part 900, the liquid that is no longer necessary in the citric acid tank 220.

The citric acid tank 220 includes, as an example, two water level gauges 222 and 224 each having a function of detecting the presence or absence of the liquid at the attached position. The water level gauge 222 is attached to be able to detect the presence or absence of the liquid at a low position in the citric acid tank 220. Consequently, a controller (not illustrated) stops the pump 118 when a liquid level is not detected by the water level gauge 222, thereby preventing the pump 118 from idling. On the other hand, the water level gauge 224 is attached to be able to detect the presence or absence of the liquid at a position higher than the water level gauge 222 in the citric acid tank 220. Consequently, the controller (not illustrated) opens the valve 138 when the water level gauge 224 detects the liquid level, thereby preventing the citric acid aqueous solution from overflowing the citric acid tank 220.

The cleaning apparatus 100 includes a drain pipe 140, and a valve 142, as an example. The drain pipe 140 communicates the case 202 with the citric acid tank 220, and has a function of discharging the citric acid aqueous solution held in the case 202 to the citric acid tank 220. Additionally, the valve 142 has a function of adjusting the flow rate of the citric acid aqueous solution flowing in the drain pipe 140.

The cleaning apparatus 100 includes a pipe 143, as an example. The pipe 143 communicates the case 202 with the citric acid tank 220, and has a function of discharging the citric acid aqueous solution held in the case 202 to the citric acid tank 220, similarly to the drain pipe 140. A port of the pipe 143 on a side communicating with the citric acid tank 220 is positioned higher than a port of the drain pipe 140 on the side communicating with the citric acid tank 220, and is positioned lower than a through hole through which the rotation shaft 106 passes, the through hole being formed in the case 202. When the liquid level of the citric acid aqueous solution in the case 202 is raised to a height of the port of the pipe 143, the citric acid aqueous solution in the case 202 is transported to the citric acid tank 220 through the pipe 143. Consequently, the pipe 143 can prevent the citric acid aqueous solution from overflowing the case 202.

The cleaning apparatus 100 includes a liquid nozzle 144, a pipe 146, a regulator 148, a valve 150, and a flow meter 152, as an example. The pipe 146 communicates, with the liquid nozzle 144, a liquid source 902 for supplying water. Consequently, the water is supplied from the liquid source 902 to the liquid nozzle 144. Although the liquid nozzle 114 is not illustrated in FIG. 5, a spray port of the liquid nozzle 144 is provided to be directed toward the electrical contact 50 of the second holding member 32 held by the rotation member 102, similarly to the nozzle 204 illustrated in FIG. 5. Therefore, the liquid nozzle 144 can spray the water on the electrical contact 50 of the second holding member 32, so that the electrical contact 50 can be cleaned with the water. Additionally, the regulator 148, the valve 150, and the flow meter 152 are attached to the pipe 146. The regulator 148 has a function of reducing a pressure of the water flowing in the pipe 146, and the flow meter 152 has a function of measuring a flow rate of the water flowing in the pipe 146. The valve 150 has a function of adjusting the flow rate of the water flowing in the pipe 146.

The cleaning apparatus 100 includes an air nozzle 154, a pipe 156, a filter 158, a regulator 160, a valve 162, and a flow meter 164, as an example. The pipe 156 communicates, with the air nozzle 154, an air source 904 for supplying air. Consequently, the air is supplied from the air source 904 to the air nozzle 154. Although the air nozzle 154 is not illustrated in FIG. 5, a spray port of the air nozzle 154 is provided to be directed toward the electrical contact 50 of the second holding member 32 held by the rotation member 102, similarly to the nozzle 204 illustrated in FIG. 5. Therefore, the air nozzle 154 can spray the air on the electrical contact 50 of the second holding member 32, so that the electrical contact 50 can be dried. Additionally, the filter 158, the regulator 160, the valve 162, and the flow meter 164 are attached to the pipe 156. The filter 158 has a function of removing particles from the air flowing in the pipe 156. The regulator 160 has a function of reducing a pressure of the water flowing in the pipe 156. The flow meter 164 has a function of measuring a flow rate of the air flowing in the pipe 156. The valve 162 has a function of adjusting the flow rate of the air flowing in the pipe 156.

The cleaning apparatus 100 includes a warm air device 166, as an example. The warm air device 166 is attached to the case 202. The warm air device 166 has a function of sending warm air, and sends the warm air into the case 202 through an opening 203 of the case 202. The warm air device 166 and the case 202 are configured so that the second holding member 32 held by the rotation member 102 is positioned at a warm air sending destination. Therefore, the warm air device 166 can send the warm air toward the second holding member 32.

<Cleaning Method>

Next, an example of a cleaning operation in the cleaning apparatus 100 will be described with reference to FIGS. 1 and 5. In the initial state, the valve 124, the valve 132, the valve 136, the valve 138, the valve 142, the valve 150, and the valve 162 are closed, and the actuator 104 is stopped.

Additionally, the case 202 does not hold, therein, a liquid such as a citric acid aqueous solution or water. The second holding member 32 is attached to the first holding member 31.

First, as illustrated in FIG. 1, the first holding member 31 and the second holding member 32 are separated from each other (corresponding to an example of a separation step). Next, the second holding member 32 is held by the rotation member 102 (see FIG. 5). In the present embodiment, the first holding member 31 separated from the second holding member 32 is not attached to the cleaning apparatus 100. That is, the second holding member 32 is accommodated in the cleaning apparatus 100 isolated from the first holding member 31.

Next, the valve 132 is opened, and the pump 118 and the constant temperature oven 128 are started. Consequently, the citric acid aqueous solution in the citric acid tank 220 is heated to a temperature of 35 to 55 degrees Celsius inclusive.

Subsequently, the actuator 104 is started. Consequently, the ring-shaped second holding member 32 having the electrical contacts 50 rotates in the circumferential direction (corresponding to an example of a rotation step). At this time, the second holding member 32 rotates at 1 to 10 rpm, as an example.

Subsequently, the valve 150 is opened. Consequently, the liquid nozzle 144 sprays the water on the electrical contact 50 at a flow rate of 2 L/min. As a result, the second holding member 32 including the electrical contacts 50 is cleaned with the water (corresponding to an example of a first water cleaning step). Note that the spray of the water from the liquid nozzle 144 is performed for 10 minutes or more. At this time, the water sprayed from the liquid nozzle 144 is accumulated in the case 202 (see FIG. 5). As a result, some of the electrical contacts 50 are immersed in the water held in the case 202, and the second holding member 32 including the electrical contacts 50 are also cleaned with the water held in the case 202 (corresponding to an example of the first water cleaning step). Subsequently, the valve 150 is closed and the valve 136 is opened. Consequently, the spray from the liquid nozzle 144 is stopped, and the water held in the case 202 is discharged.

Subsequently, the valve 136 is closed, and the valve 124 is opened. Consequently, the nozzle 204 sprays the citric acid aqueous solution on the electrical contact 50 at a flow rate of 0.4 L/min. Then, the electrical contacts 50 are cleaned with the citric acid aqueous solution (corresponding to an example of a cleaning step). Note that the spray of the citric acid aqueous solution from the nozzle 204 is performed for 60 minutes or more. At this time, the citric acid aqueous solution sprayed from the nozzle 204 is accumulated in the case 202. As a result, some of the electrical contacts 50 are immersed in the citric acid aqueous solution held in the case 202, and the electrical contacts 50 are also cleaned with the citric acid aqueous solution held in the case 202 (corresponding to an example of the cleaning step). At this time, the electrical contacts 50 are rotating together with the second holding member 32. Therefore, the citric acid aqueous solution contacting the electrical contacts 50 causes convection, whereby more dirt can be removed from the electrical contacts 50 than a case where the citric acid aqueous solution does not cause convection.

Subsequently, the valve 124 is closed and the valve 142 is opened. Then, the citric acid aqueous solution held in the case 202 is discharged to the citric acid tank 220. Consequently, the citric acid aqueous solution used for cleaning can be transported from the case 202 to the citric acid tank 220, whereby the cleaning apparatus 100 can reuse the citric acid aqueous solution.

Subsequently, the valve 142 is closed and the valve 150 is opened. Consequently, the liquid nozzle 144 sprays the water on the electrical contact 50 at a flow rate of 2 L/min. As a result, the second holding member 32 including the electrical contacts 50 is cleaned with the water (corresponding to an example of a second water cleaning step). Note that the spray of the water from the liquid nozzle 144 is performed for 10 minutes or more. At this time, the water sprayed from the liquid nozzle 144 is accumulated in the case 202. As a result, a part of the second holding member 32 including the electrical contacts 50 is immersed in the water held in the case 202, and the second holding member 32 is also cleaned with the water held in the case 202 (corresponding to an example of the second water cleaning step). Consequently, the citric acid aqueous solution on the second holding member 32 is rinsed away with the water. Next, the valve 150 is closed and the valve 136 is opened. Consequently, the water held in the case 202 is discharged.

Subsequently, the valve 162 is opened. Consequently, the air nozzle 154 sprays air on the second holding member 32 at a flow rate of 2 L/min. Note that the spray of the air from the air nozzle 154 is performed for 10 minutes or more. Consequently, the water on the second holding member 32 including the electrical contacts 50 is blown away, whereby the second holding member 32 is dried (corresponding to an example of a drying step).

Subsequently, the valve 162 is closed and the warm air device 166 sends, to the second holding member 32, the warm air having a temperature of 45 degrees Celsius or higher. Note that the warm air is sent by the warm air device 166 for 60 minutes or more. Consequently, the remaining water on the second holding member 32 without being dried by the spray of the air from the air nozzle 154 is evaporated to dryness (corresponding to an example of a drying step).

Note that the drying step by the air nozzle 154 and the drying step by the warm air device 166 may be performed simultaneously, or the drying step by the warm air device 166 may be performed prior to the drying step by the air nozzle 154.

Subsequently, the actuator 104 is stopped, and the rotation of the second holding member 32 in the circumferential direction is stopped. Then, the operation in the cleaning apparatus 100 is completed.

The cleaning with the citric acid aqueous solution can remove dirt such as copper, copper oxides, and resists on the electrical contacts 50, the dirt being unable to be sufficiently removed by cleaning with the water. Therefore, the cleaning apparatus 100 can remove the dirt on the electrical contacts 50 with the citric acid aqueous solution, the dirt being unable to be removed with deionized water. Additionally, the citric acid aqueous solution does not cause corrosion and degradation of materials of which the substrate holder 30 is made, the materials including a polyetheretherketone resin, fluorine rubber, stainless steel, and the like. Therefore, the cleaning apparatus 100 can clean the electrical contacts 50 without separating them from the second holding member 32 of the substrate holder 30, and does not adversely affect the second holding member 32. Furthermore, the citric acid aqueous solution neither destroys the electrolyte of the plating solution nor adversely affects the plating solution. Therefore, even if after cleaning with the citric acid aqueous solution, the citric acid remaining on the electrical contacts 50 is mixed into the plating solution, the electrical contacts 50 cleaned by the cleaning apparatus 100 does not adversely affect the plating solution.

Note that the percent concentration of mass of the citric acid aqueous solution is preferably 2 to 30%, and the temperature of the citric acid aqueous solution is preferably 20 to 45 degrees Celsius.

The cleaning apparatus 100 cleans the second holding member 32 with the water before cleaning the electrical contacts 50 with the citric acid aqueous solution. That is, the dirt is roughly removed from the electrical contacts 50 attached to the second holding member 32 by cleaning with the water, and then the electrical contacts 50 are cleaned with the citric acid aqueous solution. Therefore, the citric acid aqueous solution used for cleaning is less dirty.

When the citric acid aqueous solution enters a gap between the members forming the second holding member 32 and the citric acid aqueous solution is dried, citric acid powder may remain in the gap between the members. On the other hand, since the cleaning apparatus 100 cleans the substrate holder 30 with the water before cleaning with the citric acid aqueous solution, a water film is formed in the gap. The water film prevents the citric acid aqueous solution from entering the gap. As a result, the citric acid powder can be prevented from remaining in the gap.

Second Embodiment

Next, a cleaning apparatus 400 according to a second embodiment will be described with reference to the drawings. First, a configuration of the cleaning apparatus 400 according to the second embodiment will be described. Next, a cleaning method in the cleaning apparatus 400 will be described. Subsequently, a modified example of the cleaning apparatus 400 will be described.

<Configuration of Cleaning Apparatus>

Figure 6:
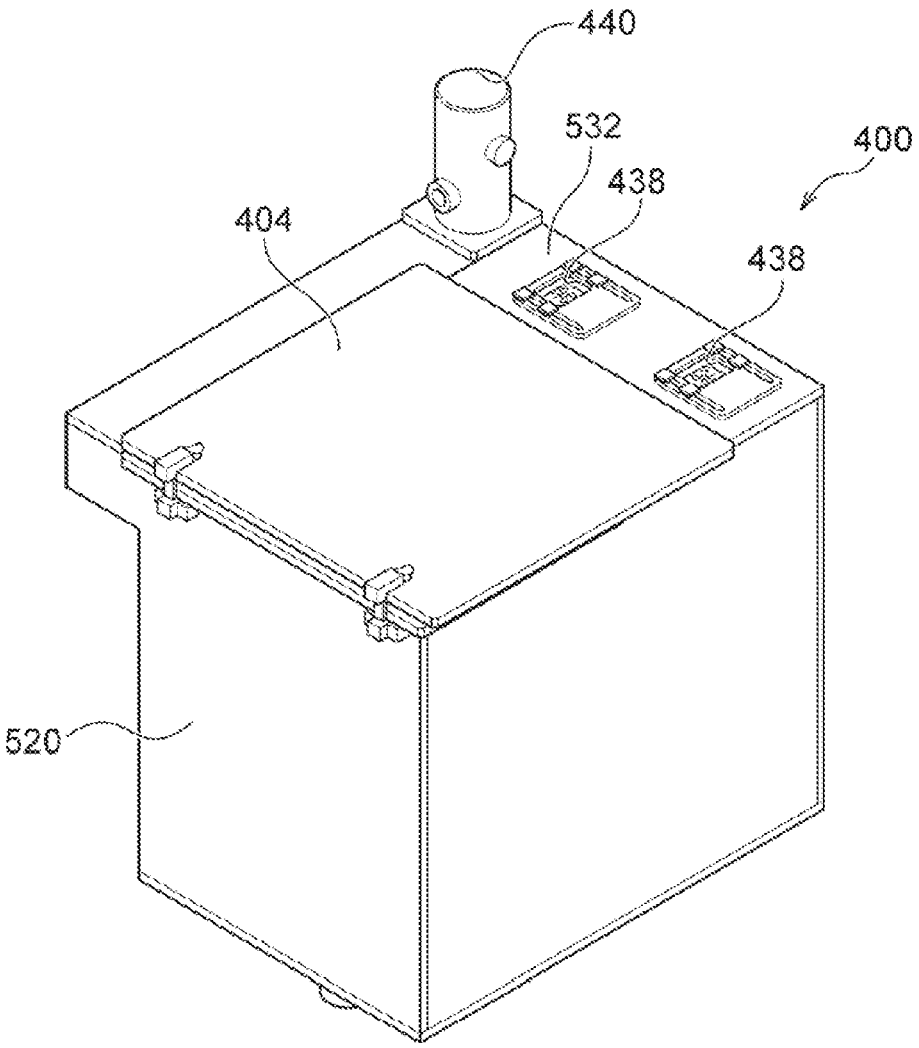
FIG. 6 is a perspective view illustrating a cleaning apparatus according to the present disclosure different from the cleaning apparatus illustrated in FIG. 4.
Figure 7:
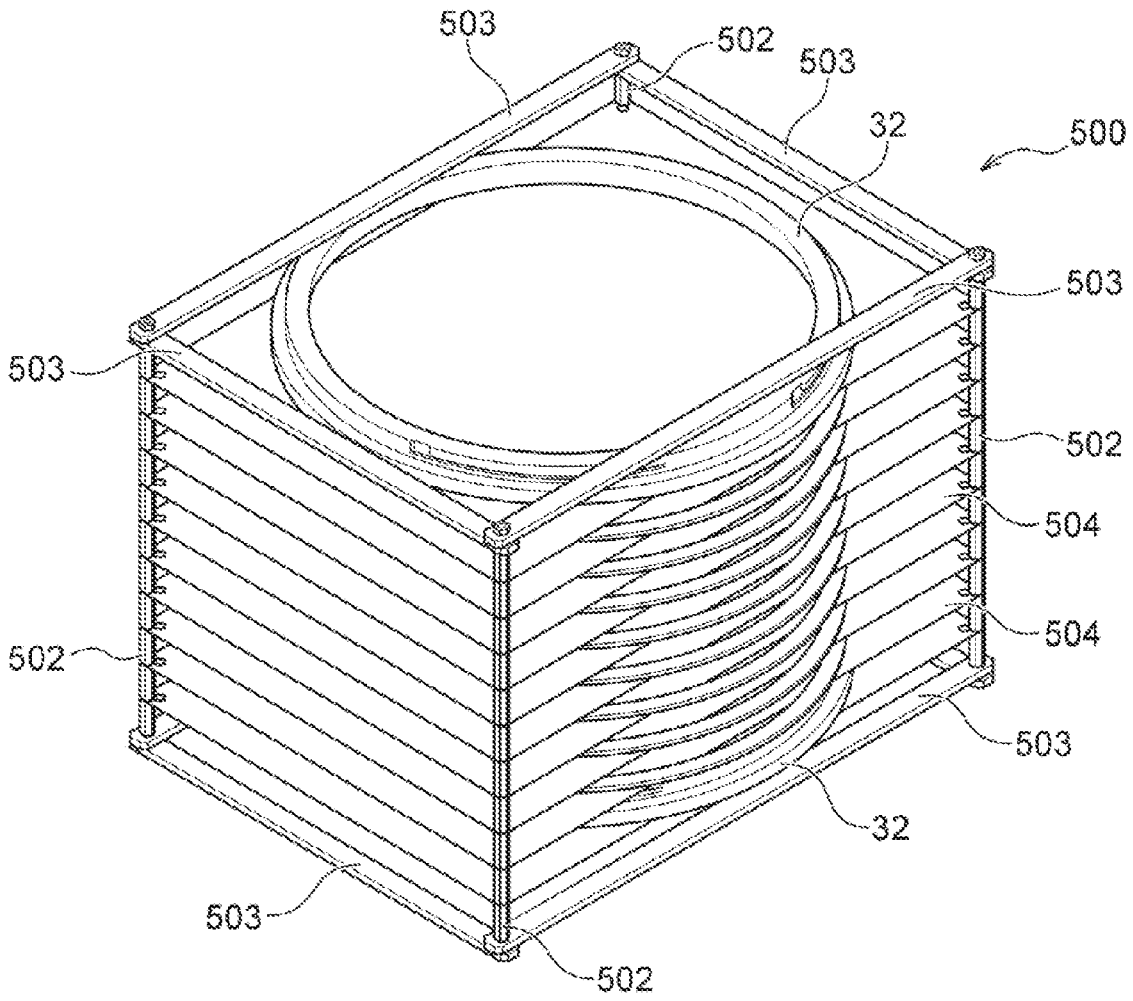
FIG. 7 is a perspective view of a carrier to be accommodated in a cleaning tank of the cleaning apparatus illustrated in FIG. 6.

FIG. 6 is a perspective view illustrating the cleaning apparatus 400 according to the present disclosure different from the cleaning apparatus 100. FIG. 7 is a perspective view of a carrier 500 to be accommodated in a cleaning tank 520 of the cleaning apparatus 400. The cleaning apparatus 400 is an apparatus for cleaning electrical contacts 50, similarly to the above-described cleaning apparatus 100. Referring to FIG. 6, the cleaning apparatus 400 includes the cleaning tank 520, a lid 404, and the carrier 500 (see FIG. 8). Hereinafter, each component of the cleaning apparatus 400 will be described.

Figure 8:
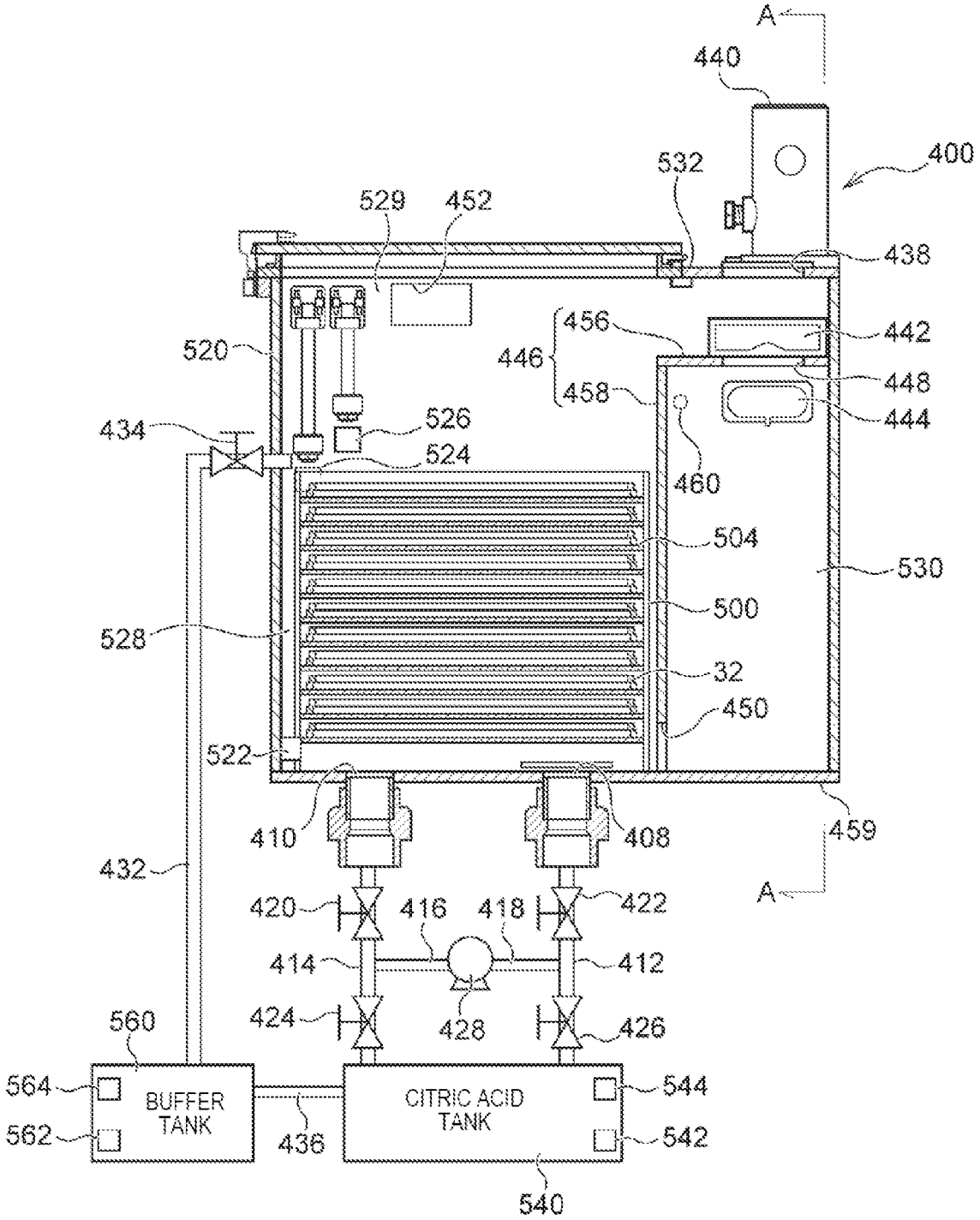
FIG. 8 is a cross-sectional view of the cleaning apparatus illustrated in FIG. 6.

The cleaning tank 520 has a substantially rectangular parallelepiped shape, and is configured to be able to accommodate the carrier 500 (see FIG. 8). Additionally, the cleaning tank 520 has a function of holding therein a liquid such as a citric acid aqueous solution or water. The lid 404 is openably/closably attached to the cleaning tank 520. In a state where the lid 404 is opened, the carrier 500 is accommodated in and removed from the cleaning tank 520.

Referring to FIG. 7, the carrier 500 has a substantially rectangular parallelepiped shape, and includes four columns 502, eight beams 503, and a plurality of mesh plates 504. The four columns 502 extending in an up-down direction are arranged to form a square. Upper ends of the respective columns 502 are connected to the beams 503 arranged to form a square, and lower ends of the respective columns 502 are connected to the other beams 503 arranged to form a square. The plurality of mesh plates 504 each have a square shape, and are arranged at equal intervals in the up-down direction. Four corners of the mesh plate 504 are fixed by the four columns 502. In other words, the carrier 500 has a shelf configuration in which the mesh plates 504 are mounting stages. Consequently, each of the plurality of mesh plates 504 can support the second holding member 32.

Figure 9:
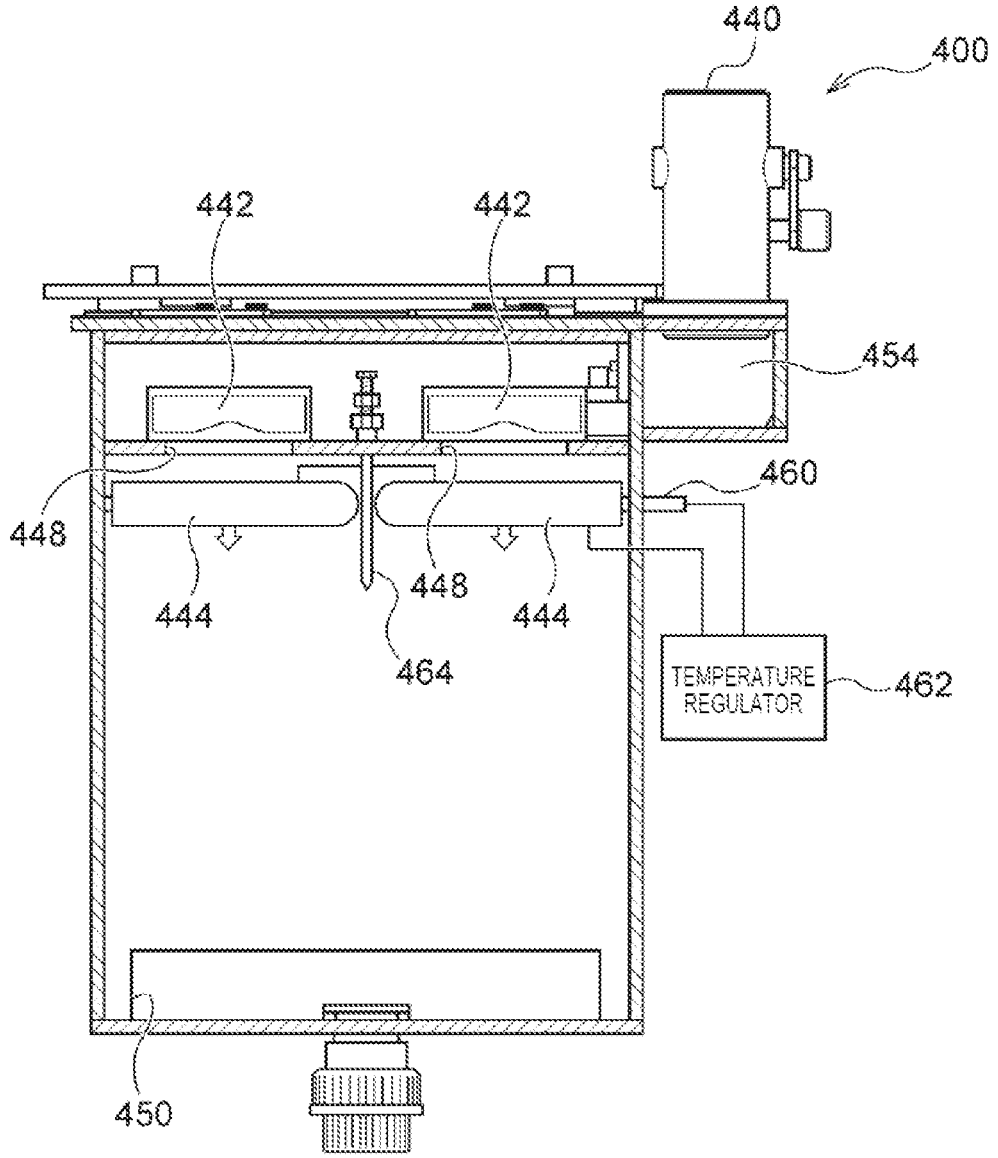
FIG. 9 is a cross-sectional view taken along line A-A in FIG. 8.

FIG. 8 is a cross-sectional view of the cleaning apparatus 400, and FIG. 9 is a cross-sectional view taken along line A-A in FIG. 8. Referring to FIG. 8, the cleaning apparatus 400 further includes a citric acid tank 540, a supply port 408, a discharge port 410, four pipes 412, 414, 416, and 418, four valves 420, 422, 424, and 426, and a pump 428, as an example.

The citric acid tank 540 has a function of holding a citric acid aqueous solution therein. In the present embodiment, the citric acid tank 540 holds the citric acid aqueous solution therein, and the percent concentration of mass of citric acid in the citric acid aqueous solution is 2 to 30%. The supply port 408 and the discharge port 410 are formed in a bottom of the cleaning tank 520. The pipe 412 communicates the supply port 408 with the citric acid tank 540, and the valve 422 and the valve 426 are attached to the pipe 412 in this order from the supply port 408 side. On the other hand, the pipe 414 communicates the discharge port 410 with the citric acid tank 540, and the valve 420 and the valve 424 are attached to the pipe 414 in this order from the discharge port 410 side. Additionally, the pipe 416 communicates a portion between the valve 420 and the valve 424 of the pipe 414 with a suction port of the pump 428. The pipe 418 communicates a portion between the valve 422 and the valve 426 of the pipe 412 with a discharge port of the pump 428.

Consequently, when the valve 424 and the valve 422 are opened in a state where the valve 420 and the valve 426 are closed, the pump 428 can supply the citric acid aqueous solution held in the citric acid tank 540 into the cleaning tank 520 through the supply port 408. When the valve 420 and the valve 426 are opened in a state where the valve 422 and the valve 424 are closed, the pump 428 can suck the citric acid aqueous solution held in the cleaning tank 520 through the discharge port 410, and supply it to the citric acid tank 540. Furthermore, when the valve 424 and the valve 426 are closed and the valve 420 and 422 are opened in a state where the cleaning tank 520 holds the liquid, the pump 428 can suck the liquid in the cleaning tank 520 through the discharge port 410. Then, the pump 428 can supply the sucked liquid into the cleaning tank 520 through the supply port 408. Consequently, the pump 428 can circulate the liquid in the cleaning tank 520, which causes convection.

Additionally, the cleaning apparatus 400 includes a buffer tank 560, a pipe 432, and a valve 434, as an example. The buffer tank 560 has a function of holding therein a liquid such as water or a citric acid aqueous solution. The pipe 432 communicates the cleaning tank 520 with the buffer tank 560, and has a function of discharging the liquid held in the cleaning tank 520 to the buffer tank 560. A port of the pipe 432 on the cleaning tank 520 side is positioned at a position higher than a water level gauge 524 (described later) and at a position lower than a water level gauge 526 (described later). When a liquid level of the liquid in the cleaning tank 520 is raised to a height of the port of the pipe 432, the liquid in the cleaning tank 520 is transported to the buffer tank 560 through the pipe 432. Consequently, the pipe 432 can prevent the liquid from overflowing the cleaning tank 520. Note that in the present embodiment, the port of the pipe 432 is arranged at a position capable of discharging the liquid when an amount of the liquid in the cleaning tank 520 reaches 72 L or more. The valve 434 is attached to the pipe 432, and has a function of adjusting a flow rate of the fluid flowing in the pipe 432. Although the valve 434 is normally open, the valve 434 is closed, at the time of drying the second holding member 32, which will be described later.

The cleaning tank 520 includes three water level gauges 522, 524, and 526 each having a function of detecting the presence or absence of the liquid at the attached position, as an example. The water level gauge 522 is attached inside the cleaning tank 520 to be able to detect the presence or absence of the liquid at a position lower than the second holding member 32 accommodated in the cleaning tank 520. More specifically, the water level gauge 522 is arranged at a position capable of detecting whether an amount of the liquid in the cleaning tank 520 is 1 L or more. Additionally, the water level gauge 524 is attached inside the cleaning tank 520 to be able to detect the presence or absence of the liquid at a position higher than the second holding member 32 accommodated in the cleaning tank 520.

Additionally, the water level gauge 526 is attached inside the cleaning tank 520 to be able to detect the presence or absence of the liquid at a position higher than the water level gauge 524. More specifically, the water level gauge 526 is arranged at a position capable of detecting whether an amount of the liquid in the cleaning tank 520 is 80 L or more. Since the water level gauge 526 is positioned at a position higher than the above-described port of the pipe 432, the liquid is not detected by the water level gauge 526 normally. Therefore, if the water level gauge 526 detects the liquid, there is a high possibility that a failure such as clogging of the pipe 432 by the liquid has occurred in the cleaning apparatus 400. Accordingly, in a case where the water level gauge 526 detects the liquid, the cleaning apparatus 400 is configured to be stopped. Consequently, the cleaning apparatus 400 prevents an accident from being caused by the failure.

The cleaning apparatus 400 includes a pipe 436, as an example. The pipe 436 communicates the citric acid tank 540 with the buffer tank 560, and has a function of discharging the liquid held in the citric acid tank 540 to the buffer tank 560. A port of the pipe 436 on a side communicating with the citric acid tank 540 is arranged at a position higher than a water level gauge 544 (described later). When a liquid level of the liquid in the citric acid tank 540 is raised to a height of the port of the pipe 436, the liquid in the citric acid tank 540 is transported to the buffer tank 560 through the pipe 436. In other words, the pipe 436 can prevent the citric acid aqueous solution from overflowing the citric acid tank 540. Note that in the present embodiment, the port of the pipe 436 is arranged at a position capable of discharging the liquid when an amount of the liquid in the citric acid tank 540 reaches 85 L or more.

The citric acid tank 540 includes, as an example, two water level gauges 542 and 544 each having a function of detecting the presence or absence of the liquid at the attached position. The water level gauge 542 is arranged at a position capable of detecting whether an amount of the liquid in the citric acid tank 540 is 10 L or more. Additionally, the water level gauge 544 is arranged at a position capable of detecting whether an amount of the liquid in the citric acid tank 540 is 82 L or more.

The buffer tank 560 includes, as an example, two water level gauges 562 and 564 each having a function of detecting the presence or absence of the liquid at the attached position. The water level gauge 562 is arranged at a position capable of detecting whether an amount of the liquid in the buffer tank 560 is 1 L or more. When the water level gauge 562 detects the liquid, the cleaning apparatus 400 discharges the liquid in the buffer tank 560 to a waste liquid part in a factory (not illustrated) by a known method.

Additionally, the water level gauge 564 is arranged at a position capable of detecting whether an amount of the liquid in the buffer tank 560 is 10 L or more. In a case where the water level gauge 564 detects the liquid, the cleaning apparatus 400 is configured to be stopped. Since the water level gauge 564 is positioned at a position higher than the water level gauge 562, the liquid is not detected by the water level gauge 564 normally, similarly as the water level gauge 526 described above. Therefore, if the water level gauge 564 detects the liquid, there is a high possibility that a failure has occurred in the cleaning apparatus 400. Accordingly, in a case where the water level gauge 564 detects the liquid, the cleaning apparatus 400 is stopped, whereby the cleaning apparatus 400 can prevent an accident from being caused by the failure.

The cleaning apparatus 400 includes two air inlets 438 (see FIG. 6), an air outlet 440, two fans 442 (see FIG. 9), two heaters 444, a discharge air flow path 454, a partition plate 446 (see, FIG. 8), two first openings 448, a second opening 450, and an opening 452, as an example. Referring to FIG. 8, the partition plate 446 is an L-shaped thin plate member, and partitions the cleaning tank 520 into a first chamber 528 and a second chamber 530. The partition plate 446 has an upper surface 456 and a side surface 458. The upper surface 456 is positioned directly below and spaced from the air inlets 438 formed in an upper surface 532 of the cleaning tank 520. The first chamber 528 communicates with the air inlets 438, not through the second chamber 530. The side surface 458 extends from the upper surface 456 to a lower surface 459 of the cleaning tank 520. Therefore, the second chamber 530 has a substantially rectangular parallelepiped shape, and the first chamber 528 has an L shape formed by cutting out the second chamber 530 from the substantially rectangular parallelepiped shape. The first openings 448 are formed in the upper surface 456 of the partition plate 446, and the second opening 450 is formed in the side surface 458 of the partition plate 446. In the first chamber 528, the carrier 500 is arranged at a position adjacent to the second opening 450. The opening 452 is formed in a side surface 529 of the first chamber 528 and at a position higher than the water level gauge 524. The opening 452 communicates with the air outlet 440 through the discharge air flow path 454 (see FIG. 9). In other words, the first chamber 528 communicates with the air outlet 440, not through the second chamber 530. The fan 442 is arranged in the first chamber 528 and directly above the first opening 448 formed in the upper surface 456 (see FIG. 8). Therefore, the fan 442 can send, to the first opening 448, the air in the first chamber 528 and the air sucked from outside the cleaning tank 520 through the air inlet 438. The air sent to the first opening 448 flows in the second chamber 530 and is supplied to the second holding member 32 held in the carrier 500 through the second opening 450. That is, the second chamber 530 forms a flow path from the first opening 448 to the second opening 450. As described above, the second holding member 32 is supported by the mesh plate 504 of the carrier 500. The air supplied to the second holding member 32 through the second opening 450 is dispersed, in the cleaning tank 520, by the meshes provided in the mesh plates 504. As a result, the temperature inside the cleaning tank 520 can be uniformized. The two heaters 444 are arranged in the second chamber 530. Therefore, the two heaters 444 can heat the air to be sent to the second holding member 32.

The cleaning apparatus 400 includes a thermometer 460, and a temperature regulator 462, as an example (see FIGS. 8 and 9). A temperature measurement portion of the thermometer 460 is positioned inside the second chamber 530 of the cleaning tank 520. Therefore, the thermometer 460 has a function of measuring a temperature of the air in the second chamber 530. Additionally, the temperature regulator 462 is arranged outside the cleaning tank 520, and is electrically connected to the thermometer 460 and the two heaters 444. The temperature regulator 462 has a function of controlling the heaters 444 based on the temperature measured by the thermometer 460. Consequently, the inside of the cleaning tank 520 is maintained at a predetermined temperature. Note that in the present embodiment, the temperature regulator 462 controls the heaters 444 so that the temperature inside the cleaning tank 520 becomes a temperature of 40 to 50 degrees Celsius inclusive, at the time of drying the second holding member 32, which will be described later.

The cleaning apparatus 400 further includes a thermostat 464, as an example (see FIG. 9). The thermostat 464 is arranged inside the second chamber 530. The thermostat 464 has a function of stopping the two heaters 444 when the temperature inside the second chamber 530 exceeds 60 degrees Celsius.

<Cleaning Method>

Next, an operation in the cleaning apparatus 400 will be described with reference to FIGS. 1 and 8. In the initial state, the second holding member 32 is attached to the first holding member 31, and the valve 420, the valve 422, the valve 424, and the valve 426 are closed, as an example. Additionally, the cleaning tank 520 does not hold, therein, a liquid such as a citric acid aqueous solution or water.

First, as illustrated in FIG. 1, the first holding member 31 and the second holding member 32 are separated from each other (corresponding to an example of a separation step). Next, at least one second holding member 32 is held by the carrier 500, and the carrier 500 is arranged inside the cleaning tank 520 (see FIG. 8). In the present embodiment, the first holding member 31 separated from the second holding member 32 is not accommodated in the cleaning tank 520. That is, the second holding member 32 is accommodated in the cleaning apparatus 400 isolated from the first holding member 31.

First, water is supplied into the cleaning tank 520 by a known liquid supply device (not illustrated). Consequently, a water level in the cleaning tank 520 is raised. When the water level gauge 524 detects the water, the supply of the water is stopped. As a result, the entirety of the second holding member 32 is immersed in the water (corresponding to an example of a first water cleaning step).

Next, the valve 420 and the valve 422 are opened. Consequently, the water in the cleaning tank 520 is discharged through the discharge port 410, and the water discharged through the discharge port 410 is supplied into the cleaning tank 520 through the supply port 408. As a result, the water in the cleaning tank 520 is circulated, which causes convection. Note that the pump 428 circulates the water in the cleaning tank 520 for 10 minutes or more.

Subsequently, the valve 420 and the valve 422 are closed. Then, the water in the cleaning tank 520 is discharged by the known liquid discharge device (not illustrated).

Subsequently, the water level gauge 544 of the citric acid tank 540 confirms the presence or absence of the citric acid aqueous solution. Consequently, it is confirmed that a sufficient amount of citric acid aqueous solution is held in the citric acid tank 540. In a case where the water level gauge 544 detects the citric acid aqueous solution, the valve 424 and the valve 422 are opened, and the citric acid aqueous solution is supplied into the cleaning tank 520. Consequently, the liquid level in the cleaning tank 520 is raised. When the water level gauge 524 detects the citric acid aqueous solution, the supply of the citric acid aqueous solution is stopped. As a result, the entirety of the second holding member 32 is immersed in the citric acid aqueous solution (corresponding to an example of an immersion step). In a case where the citric acid aqueous solution is not detected by the water level gauge 544, the cleaning apparatus 400 notifies an operator that an amount of the citric acid aqueous solution is insufficient, by the known method.

Subsequently, the valve 420 and the valve 422 are opened. Consequently, the citric acid aqueous solution in the cleaning tank 520 is discharged through the discharge port 410, and the citric acid aqueous solution discharged through the discharge port 410 is supplied into the cleaning tank 520 through the supply port 408. As a result, the citric acid aqueous solution in the cleaning tank 520 is circulated, which causes convection. Consequently, more dirt is removed from the electrical contacts 50. Note that the pump 428 circulates the citric acid aqueous solution in the cleaning tank 520 for 60 minutes or more.

Subsequently, the water level gauge 542 of the citric acid tank 540 confirms the presence or absence of the citric acid aqueous solution. Consequently, it is confirmed that the citric acid tank 540 has an empty volume sufficient to hold the citric acid aqueous solution. In a case where the water level gauge 544 detects the citric acid aqueous solution, the cleaning apparatus 400 notifies the operator that the empty volume of the citric acid tank 540 is insufficient, by the known method. On the other hand, in a case where the citric acid aqueous solution is not detected by the water level gauge 544, the valve 422 is closed, and the valve 426 is opened. Consequently, the pump 428 pressure-feeds the citric acid aqueous solution in the cleaning tank 520 to the citric acid tank 540, to empty the cleaning tank 520. Then, the valve 420 and the valve 426 are closed. In this way, the citric acid aqueous solution is collected in the citric acid tank 540. At this time, since as described above, cleaning with the water is performed before cleaning with the citric acid aqueous solution, the water used for the above-described cleaning with the water is mixed in the citric acid aqueous solution collected in the citric acid tank 540. Therefore, an amount of the collected citric acid aqueous solution increases more than an amount of the citric acid aqueous solution supplied from the citric acid tank 540 to the cleaning tank 520. Here, as described above, the cleaning apparatus 400 includes the pipe 436 for discharging the liquid to the buffer tank 560 when an amount of the liquid in the citric acid tank 540 reaches a certain amount or more. Therefore, the increased citric acid aqueous solution can be transported to the buffer tank 560 through the pipe 436, thereby preventing the citric acid aqueous solution from overflowing the citric acid tank 540.

Subsequently, the second holding member 32 is cleaned again. Specifically, the water is supplied into the cleaning tank 520 by the known liquid supply device (not illustrated). Consequently, a water level of the water in the cleaning tank 520 is raised. When the water level gauge 524 detects the water, the supply of the water is stopped. As a result, the entirety of the second holding member 32 is immersed in the water (corresponding to an example of a second water cleaning step).

Next, the valve 420 and the valve 422 are opened. Consequently, the water in the cleaning tank 520 is discharged through the discharge port 410, and the water discharged through the discharge port 410 is supplied into the cleaning tank 520 through the supply port 408. As a result, the water in the cleaning tank 520 is circulated, which causes convection. Note that the pump 428 circulates the water in the cleaning tank 520 for 10 minutes or more.

Subsequently, the valve 420 and the valve 422 are closed. Then, the water in the cleaning tank 520 is discharged by the known liquid discharge device (not illustrated).

Subsequently, the water level gauge 522 of the cleaning tank 520 confirms the presence or absence of the water. Consequently, it is confirmed that the water does not remain in the cleaning tank 520. After the water is not detected by the water level gauge 522, the cleaning apparatus 400 starts the drying step of drying the second holding member 32. Specifically, the fan 442 sends the air to the second holding member 32 (corresponding to an example of an air sending step). At this time, the heater 444 heats, in the second chamber 530, the air to be sent to the second holding member 32 (corresponding to an example of a heating step). Consequently, the second holding member 32 is dried. Additionally, the fan 442 sends, to the first opening 448, the air positioned in the first chamber 528 in addition to the air sucked from outside the cleaning tank 520 through the air inlet 438. The air positioned in the first chamber 528 contains the air heated by the heater 444. Therefore, a part of the air to be heated by the heater 444 in the second chamber 530 is the already heated air. As a result, the cleaning apparatus 400 can supply high temperature air to the second holding member 32 while saving the energy for heating the air. Note that the supply of the warm air to the second holding member 32 by the fan 442 and the heater 444 is performed for 60 minutes or more. The thermometer 460 may measure the temperature of the air heated by the heater 444, at the time of drying the second holding member 32. Then, the temperature regulator 462 may control the heater 444 based on the temperature measured by the thermometer 460 to adjust the temperature of the air to be sent to the second holding member 32. Thus, the operation in the cleaning apparatus 400 is completed.

In this way, the cleaning apparatus 400 can clean the electrical contacts 50 with the citric acid aqueous solution, similarly to the above-described cleaning apparatus 100. Note that the cleaning apparatus 400 may clean the electrical contacts 50 by immersing the substrate holder 30 itself in the citric acid aqueous solution.

Additionally, the cleaning apparatus 400 can clean the second holding member 32 using the carrier 500, thereby capable of cleaning a plurality of second holding members 32 simultaneously by a single cleaning operation.

<Modified Example>

(First Modified Example)

Figure 10:
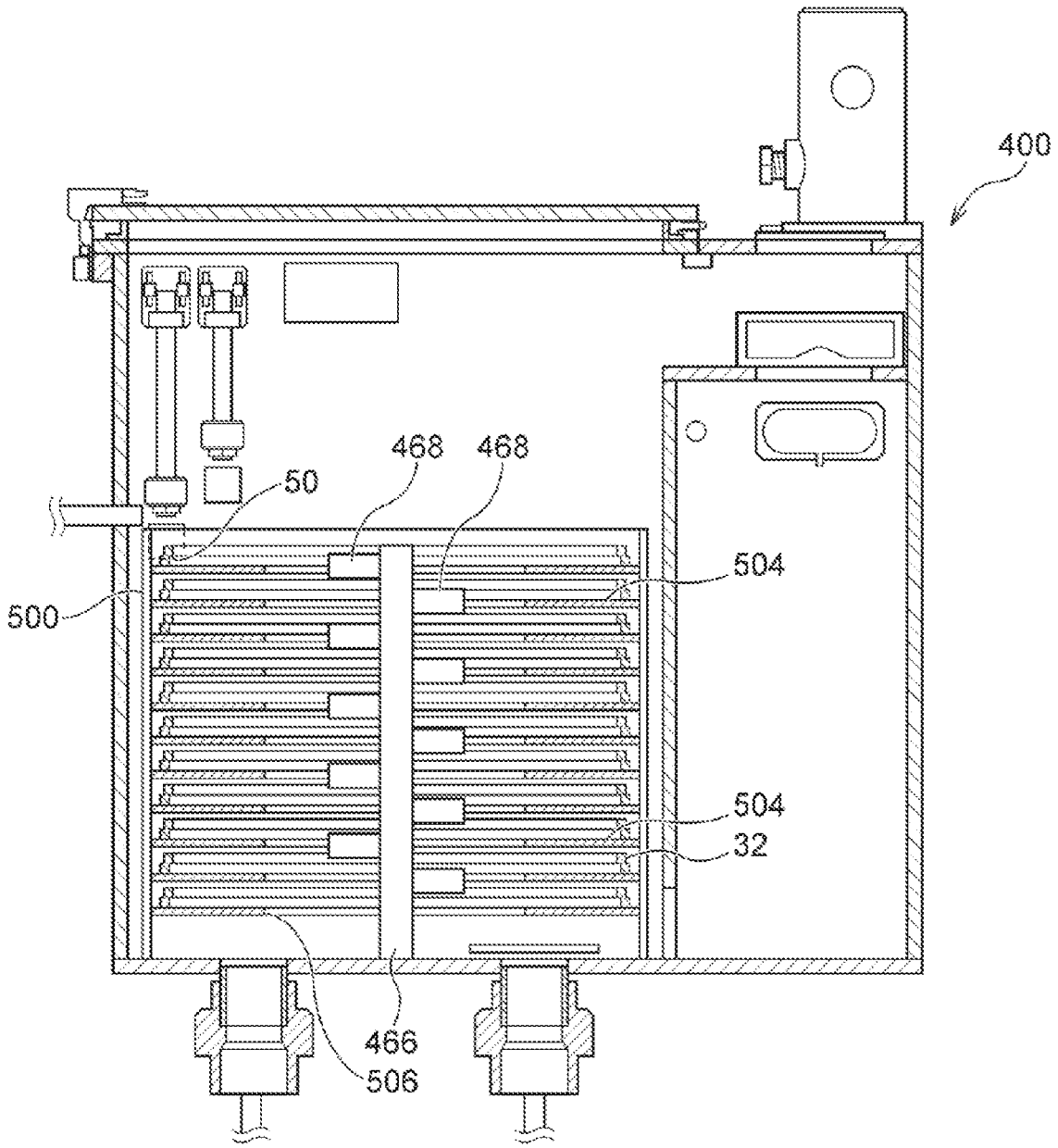
FIG. 10 is a cross-sectional view illustrating a first modified example of the cleaning apparatus illustrated in FIG. 6.

FIG. 10 is a cross-sectional view illustrating a first modified example of the cleaning apparatus 400. As illustrated in FIG. 10, the cleaning apparatus 400 may include a first rod-shaped member 466 configured to be rotatable, and nozzles 468. In this case, the nozzles 468 are attached to the first rod-shaped member 466, and are configured to be rotatable integrally with the first rod-shaped member 466. The nozzles 468 have a function of spraying a citric acid aqueous solution, water or air on the electrical contacts 50. A plurality of mesh plates 504 of the carrier 500 have respective through holes 506 formed therein, so that the first rod-shaped member 466 passes through the through holes 506.

Such a configuration of the cleaning apparatus 400 enables the nozzles 468 to spray the citric acid aqueous solution, water or air on the electrical contacts 50 while rotating integrally with the first rod-shaped member 466. Therefore, in a case where the citric acid aqueous solution is sprayed on the electrical contacts 50, the cleaning apparatus 400 can clean the electrical contacts 50 with the citric acid aqueous solution. In a case where the water is sprayed on the electrical contacts 50, the cleaning apparatus 400 can clean the electrical contacts 50 with the water. Furthermore, in a case where the air is sprayed on the electrical contacts 50, the cleaning apparatus 400 can dry the electrical contacts 50.

(Second Modified Example)

Figure 11:
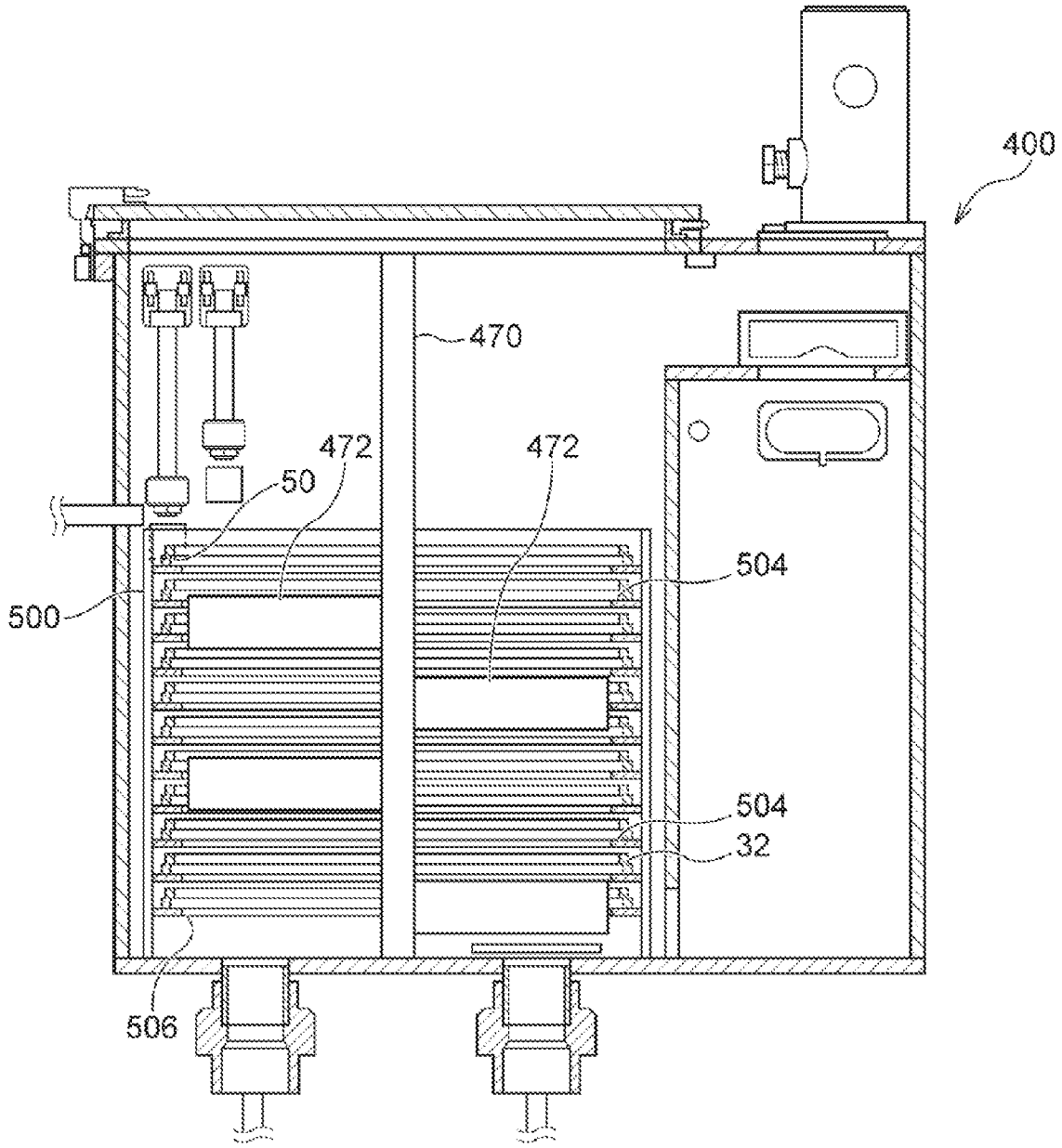
FIG. 11 is a cross-sectional view illustrating a second modified example of the cleaning apparatus illustrated in FIG. 6.

FIG. 11 is a cross-sectional view illustrating a second modified example of the cleaning apparatus 400. As illustrated in FIG. 11, the cleaning apparatus 400 may include a second rod-shaped member 470 configured to be rotatable, and agitating members 472. In this case, the agitating members 472 each are a thin plate-shaped member, are attached to the second rod-shaped member 470, and are configured to be rotatable integrally with the second rod-shaped member 470. A plurality of mesh plates 504 of the carrier 500 have respective through holes 506 formed therein, so that the second rod-shaped member 470 passes through the through holes 506.

Such a configuration of the cleaning apparatus 400 enables the agitating members 472 to agitate the liquid in the cleaning tank 520. Therefore, in a case where the cleaning tank 520 holds the citric acid aqueous solution therein, the cleaning apparatus 400 can remove more dirt from the electrical contacts 50.

In the above-described first embodiment and second embodiment, only the second holding member 32 is cleaned by the cleaning apparatus 100, 400. That is, when the second holding member 32 is cleaned by the cleaning apparatus 100, 400, the first holding member 31 is not cleaned. Therefore, the cleaning apparatus 100, 400 can be downsized as compared with a case where both of the first holding member 31 and the second holding member 32 are accommodated in the cleaning apparatus 100, 400. If a cleaning liquid (citric acid aqueous solution, or water) is attached to the first holding member 31 having a complicated structure such as a mechanism for holding the substrate Wf and an electrical system for supplying electric power to the substrate Wf, a long period of time is required to dry the cleaning liquid. In the above-described embodiments, the first holding member 31 is isolated from the interior of the cleaning apparatus 100, 400, and the cleaning apparatus 100, 400 cleans only the second holding member 32 having a relatively simple structure. Therefore, the time period required for drying can be reduced.

[Appendix]

All or part of the embodiments disclosed above can be described as, but not limited to, the following appendices.

(Appendix 1)

A cleaning method according to Appendix 1 is a cleaning method for a substrate holder having electrical contacts for supplying electric power to a substrate by contacting the substrate to plate the substrate, the method including a cleaning step of cleaning the electrical contacts of the substrate holder with a citric acid aqueous solution.

The cleaning with the citric acid aqueous solution can remove dirt such as copper, copper oxides, and resists on the electrical contacts, the dirt being unable to be sufficiently removed by cleaning with the water. Therefore, the cleaning method according to Appendix 1 can remove the dirt on the electrical contacts with the citric acid aqueous solution, the dirt being unable to be removed with deionized water. Additionally, the citric acid aqueous solution does not cause corrosion and degradation of materials of which the substrate holder is made, the materials including a polyetheretherketone resin, fluorine rubber, stainless steel, and the like.

Therefore, the cleaning method enables the electrical contacts to be cleaned without being separated from the substrate holder, and does not adversely affect the substrate holder. Furthermore, the citric acid aqueous solution neither destroys the electrolyte of the plating solution nor adversely affects the plating solution. Therefore, even if after cleaning with the citric acid aqueous solution, the citric acid remaining on the electrical contacts is mixed into the plating solution, the electrical contacts cleaned by the cleaning method does not adversely affect the plating solution.

(Appendix 2)

The cleaning method according to Appendix 2 is the cleaning method in Appendix 1 in which the substrate holder includes a first holding member having relay contacts configured to be electrically connected to an external power source, and a second holding member having the electrical contacts, the method including a separation step of separating the second holding member from the first holding member before the cleaning step, wherein the cleaning step cleans the second holding member without cleaning the first holding member.

(Appendix 3)

The cleaning method according to Appendix 3 is the cleaning method in Appendix 1 or Appendix 2, wherein a percent concentration of mass of citric acid in the citric acid aqueous solution is 2 to 30%.

(Appendix 4)

The cleaning method according to Appendix 4 is the cleaning method in any one of Appendices 1 to 3, further including a step of heating the citric acid aqueous solution to a temperature of 35 to 55 degrees Celsius inclusive, before the cleaning step.

(Appendix 5)

The cleaning method according to Appendix 5 is the cleaning method in any one of Appendices 1 to 4, further including a rotation step of rotating a ring-shaped holding member having the electrical contacts in a circumferential direction, wherein the cleaning step includes a step of spraying the citric acid aqueous solution on the electrical contact during the rotation step.

According to the cleaning method according to Appendix 5, the holding member rotating in the circumferential direction can be cleaned by spray of the citric acid aqueous solution.

(Appendix 6)

The cleaning method according to Appendix 6 is the cleaning method in Appendix 5, wherein the cleaning step includes a step of immersing some of the electrical contacts in the citric acid aqueous solution during the rotation step.

In a case where the electrical contacts are simply immersed in the citric acid aqueous solution, the citric acid aqueous solution contacting the electrical contacts hardly causes convection, resulting that the cleaning effect on the electrical contacts is not high enough. On the other hand, according to the cleaning method according to Appendix 6, the electrical contacts rotating together with the holding member is immersed and cleaned in the citric acid aqueous solution. Therefore, the citric acid aqueous solution contacting the electrical contacts causes convection, whereby more dirt can be removed from the electrical contacts.

(Appendix 7)

The cleaning method according to Appendix 7 is the cleaning method in any one of Appendices 1 to 6, further including a first water cleaning step of cleaning the substrate holder with water before the cleaning step.

According to the cleaning method according to Appendix 7, the substrate holder is cleaned with the water before the electrical contacts are cleaned with the citric acid aqueous solution. That is, the dirt is roughly removed from the electrical contacts attached to the substrate holder by cleaning with the water, and then the electrical contacts are cleaned with the citric acid aqueous solution. Therefore, the citric acid aqueous solution used for cleaning is less dirty. When the citric acid aqueous solution enters a gap between the members forming the substrate holder and the citric acid aqueous solution is dried, citric acid powder may remain in the gap between the members. On the other hand, in the cleaning method according to Appendix 7, the substrate holder is cleaned with the water before being cleaned with the citric acid aqueous solution, and therefore a water film is formed in the gap. The water film prevents the citric acid aqueous solution from entering the gap. As a result, the citric acid powder can be prevented from remaining in the gap.

(Appendix 8)

The cleaning method according to Appendix 8 is the cleaning method in any one of Appendices 5 to 7, further including a second water cleaning step of cleaning the substrate holder with the water during the rotation step and after the cleaning step.

The cleaning method according to Appendix 8 enables the citric acid aqueous solution on the substrate holder to be washed away with the water.

(Appendix 9)

The cleaning method according to Appendix 9 is the cleaning method in any one of Appendices 1 to 4, wherein the cleaning step includes an immersion step of immersing, in the citric acid aqueous solution held in a cleaning tank, an entirety of a holding member having the electrical contacts, the holding member being a member forming at least part of the substrate holder.

According to the cleaning method according to Appendix 9, the electrical contacts can be cleaned with the citric acid aqueous solution held in the cleaning tank.

(Appendix 10)

The cleaning method according to Appendix 10 is the cleaning method in Appendix 9, further including a step of discharging the citric acid aqueous solution in the cleaning tank through a discharge port and supplying the citric acid aqueous solution discharged through the discharge port into the cleaning tank through a supply port, during the immersion step.

In the cleaning method according to Appendix 10, the citric acid aqueous solution is circulated among the interior of the cleaning tank, the discharge port, and the supply port, whereby the citric acid aqueous solution in the cleaning tank causes convection. Therefore, the cleaning method enables more dirt to be removed from the electrical contacts.

(Appendix 11)

The cleaning method according to Appendix 11 is the cleaning method in Appendix 9 or 10, further including a first water cleaning step of immersing the entirety of the holding member in water held in the cleaning tank, before the cleaning step.

According to the cleaning method according to Appendix 11, the substrate holder is cleaned with the water before the electrical contacts are cleaned with the citric acid aqueous solution. Therefore, similarly to the cleaning method according to Appendix 7, the citric acid aqueous solution used for cleaning is less dirty, and the citric acid powder can be prevented from remaining in a gap of the substrate holder.

(Appendix 12)

The cleaning method according to Appendix 12 is the cleaning method in any one of Appendices 9 to 11, further including a second water cleaning step of immersing the entirety of the holding member in the water held in the cleaning tank, after the cleaning step.

According to the cleaning method according to Appendix 12, the substrate holder to which the citric acid aqueous solution is attached can be cleaned with the water.

(Appendix 13)

The cleaning method according to Appendix 13 is the cleaning method in Appendix 8 or 12, further including a drying step of drying the substance holder after the second water cleaning step.

According to the cleaning method according to Appendix 13, the substance holder to which the water is attached can be dried.

(Appendix 14)

The cleaning method according to Appendix 14 is the cleaning method in Appendix 13, wherein the drying step includes an air sending step of sending air from a fan to the holding member, and a heating step of heating the air to be sent to the holding member by a heater.

In the cleaning method according to Appendix 14, the fan can supply, to the holding member, the air heated by the heater.

(Appendix 15)

The cleaning method according to Appendix 15 is the cleaning method in Appendix 14, wherein the drying step includes a step of measuring a temperature of the air heated by the heater, and a step of controlling the heater based on the measured temperature and adjusting the temperature of the air to be sent to the holding member.

In the cleaning method according to Appendix 15, the fan can adjust the temperature of the air to be supplied to the holding member to a predetermined temperature.

(Appendix 16)

The cleaning method according to Appendix 16 is the cleaning method in Appendix 14 or 15 dependent on Appendix 12, wherein the air sending step includes a step of sending, to a first opening, air sucked from outside the cleaning tank through an air inlet by the fan, a step of passing the air sent to the first opening through a second chamber forming a flow path from the first opening to a second opening and sending the air toward the holding member arranged in a first chamber through the second opening, and a step of, by the fan, sucking the air after being sent toward the holding member, the air being positioned in the first chamber and sending the air to the first opening again, and the heating step includes a step of heating the air flowing in the second chamber.

According to the cleaning method according to Appendix 16, the air flowing in the second chamber is heated, and is sent toward the holding member arranged in the first chamber. Then, the air after being sent toward the holding member is sent to the second chamber again. Therefore, a part of the air to be supplied to the second chamber is the heated air. Accordingly, the method enables high temperature air to be supplied to the holding member while saving the energy for heating the air.

(Appendix 17)

The cleaning method according to Appendix 17 is the cleaning method in Appendix 9 or any one of Appendices 10 to 16 dependent on Appendix 9, wherein the immersion step includes a step of immersing, in the citric acid aqueous solution held in the cleaning tank, the at least one holding member supported on a mesh plate in a carrier in which a plurality of the mesh plates are arranged in an up-down direction.

The cleaning method according to Appendix 17 enables the holding member to be immersed in the citric acid aqueous solution using the carrier capable of holding a plurality of holding members therein.

(Appendix 18)

The cleaning method according to Appendix 18 is the cleaning method in Appendix 17, including a first rotation step of rotating a first rod-shaped member that is supported by the plurality of mesh plates and is positioned to pass through an inside of the holding member having a ring shape, and a step of spraying the citric acid aqueous solution, water, or air on the electrical contacts while nozzles attached to the first rod-shaped member rotates integrally with the first rod-shaped member during the first rotation step.

According to the cleaning method according to Appendix 18, the nozzles can spray the citric acid aqueous solution, the water or the air on the electrical contacts while rotating integrally with the first rod-shaped member. Therefore, in a case where the citric acid aqueous solution is sprayed on the electrical contacts, the cleaning method enables the electrical contacts to be cleaned with the citric acid aqueous solution. Additionally, in a case where the water is sprayed on the electrical contacts, the cleaning method enables the electrical contacts to be cleaned with the water. Furthermore, in a case where the air is sprayed on the electrical contacts, the cleaning method enables the electrical contacts to be dried.

(Appendix 19)

The cleaning method according to Appendix 19 is the cleaning method in Appendix 17 or 18, further including a second rotation step of rotating a second rod-shaped member that is supported by the plurality of mesh plates and is positioned to pass through an inside of the holding member having a ring shape, and a step of agitating a liquid in the cleaning tank by rotating agitating members attached to the second rod-shaped member integrally with the second rod-shaped member during the second rotation step.

The cleaning method according to Appendix 19 enables the liquid in the cleaning tank to be agitated.

(Appendix 20)

A cleaning apparatus according to Appendix 20 includes a rotation member for holding a ring-shaped holding member that holds a substrate for plating and has electrical contacts brought into contact with the substrate, an actuator for rotating the rotation member to rotate the holding member in a circumferential direction, and a cleaning module for cleaning, with a citric acid aqueous solution, the holding member rotated by the rotation member.

According to the cleaning apparatus according to Appendix 20, the holding member rotating in the circumferential direction can be cleaned with the citric acid aqueous solution. Additionally, similarly to the cleaning method according to Appendix 1, the cleaning apparatus can remove dirt on electrical contacts, the dirt being unable to be removed with deionized water, without adversely affecting a plating solution and a substrate holder which is a member for holding a substrate.

(Appendix 21)

The cleaning apparatus according to Appendix 21 is the cleaning apparatus in Appendix 20, wherein the holding member is a second holding member having the electrical contacts, and a substrate holder includes a first holding member having relay contacts configured to be electrically connected to an external power source, and the second holding member.

(Appendix 22)

The cleaning apparatus according to Appendix 22 is the cleaning apparatus in Appendix 20 or 21, wherein the cleaning module has a nozzle for spraying the citric acid aqueous solution on the holding member.

According to the cleaning apparatus according to Appendix 22, the holding member rotating in the circumferential direction can be cleaned by spray of the citric acid aqueous solution.

(Appendix 23)

The cleaning apparatus according to Appendix 23 is the cleaning apparatus in any one of Appendices 20 to 22, wherein the cleaning module includes a case holding the citric acid aqueous solution, and a part of the holding member is configured to be immersed in the citric acid aqueous solution held in the case.

In a case where the holding member having the electrical contacts is cleaned by the cleaning apparatus according to Appendix 23, the electrical contacts rotating together with the holding member are immersed in and cleaned with the citric acid aqueous solution. Therefore, the citric acid aqueous solution contacting the electrical contacts causes convection, whereby the cleaning apparatus can remove more dirt from the electrical contacts.

(Appendix 24)

The cleaning apparatus according to Appendix 24 is the cleaning apparatus in any one of Appendices 20 to 23, further including a citric acid tank for holding the citric acid aqueous solution therein, a constant temperature oven for heating the citric acid aqueous solution held in the citric acid tank to a temperature of 35 to 55 degrees Celsius inclusive, and a pump for pressure-feeding the citric acid aqueous solution held in the citric acid tank to the cleaning module.

(Appendix 25)

The cleaning apparatus according to Appendix 25 is the cleaning apparatus in Appendix 24 dependent on Appendix 23, further including a drain pipe for discharging the citric acid aqueous solution held in the case to the citric acid tank.

The cleaning apparatus according to Appendix 25 can transport the citric acid aqueous solution used for the cleaning from the case to the citric acid tank. Therefore, the cleaning apparatus can reuse the citric acid aqueous solution.

(Appendix 26)

The cleaning apparatus according to Appendix 26 is the cleaning apparatus in any one of Appendices 20 to 25, further including a liquid nozzle for spraying water on the holding member.

The cleaning apparatus according to Appendix 26 can clean the holding member with the water by spraying the water on the holding member from the liquid nozzle.

(Appendix 27)

The cleaning apparatus according to Appendix 27 is the cleaning apparatus in any one of Appendices 20 to 26, further including an air nozzle for spraying air on the holding member.

The cleaning apparatus according to Appendix 27 can dry the holding member by spraying the air on the holding member from the air nozzle.

(Appendix 28)

The cleaning apparatus according to Appendix 28 is the cleaning apparatus in any one of Appendices 20 to 27, further including a warm air device for sending warm air toward the holding member.

The cleaning apparatus according to Appendix 28 can dry the holding member by sending the warm air toward holding member by the warm air device.

(Appendix 29)

A cleaning apparatus according to Appendix 29 is a cleaning apparatus for a holding member that has electrical contacts and is a member forming at least part of a substrate holder, the cleaning apparatus including a cleaning tank for holding a citric acid aqueous solution therein and immersing the holding member in the citric acid aqueous solution.

The cleaning apparatus according to Appendix 29 can clean the electrical contacts with the citric acid aqueous solution held in the cleaning tank. Additionally, similarly to the cleaning method according to Appendix 1, the cleaning apparatus can remove dirt on electrical contacts, the dirt being unable to be removed with deionized water, without adversely affecting a plating solution and a substrate holder which is a member for holding a substrate.

(Appendix 30)

The cleaning apparatus according to Appendix 30 is the cleaning apparatus in Appendix 29, wherein the substrate holder includes a first holding member having relay contacts configured to be electrically connected to an external power source, and a second holding member having the electrical contacts, and the holding member is the second holding member.

(Appendix 31)

The cleaning apparatus according to Appendix 31 is the cleaning apparatus in Appendix 29 or 30, further including a supply port for supplying a liquid into the cleaning tank, a discharge port for discharging the liquid from an interior of the cleaning tank, and a pump configured to suck the liquid in the cleaning tank through the discharge port and supply the sucked liquid into the cleaning tank through the supply port.

The cleaning apparatus according to Appendix 31 can circulate the citric acid aqueous solution among the interior of the cleaning tank, the discharge port, the pump, and the supply port, whereby the citric acid aqueous solution in the cleaning tank can cause convection.

(Appendix 32)

The cleaning apparatus according to Appendix 32 is the cleaning apparatus in any one of Appendices 29 to 31, including a carrier accommodated in the cleaning tank, wherein the carrier includes a plurality of mesh plates for supporting the holding member, the plurality of mesh plates being arranged in an up-down direction.

According to the cleaning apparatus according to Appendix 32, the carrier can hold a plurality of holding members. Therefore, the cleaning apparatus can immerse the plurality of holding members in the citric acid aqueous solution at one time by using the carrier.

(Appendix 33)

The cleaning apparatus according to Appendix 33 is the cleaning apparatus in Appendix 32, further including a first rod-shaped member configured to be rotatable, and nozzles for spraying the citric acid aqueous solution, water, or air on the electrical contacts, the nozzles being attached to the first rod-shaped member and being rotatable integrally with the first rod-shaped member, wherein the plurality of mesh plates have respective through holes through which the first rod-shaped member passes.

According to the cleaning apparatus according to Appendix 33, the nozzles can spray the citric acid aqueous solution, the water, or the air on the electrical contacts while rotating integrally with the first rod-shaped member. Therefore, in a case where the citric acid aqueous solution is sprayed on the electrical contacts, the cleaning apparatus can clean the electrical contacts with the citric acid aqueous solution. Additionally, in a case where the water is sprayed on the electrical contacts, the cleaning apparatus can clean the electrical contacts with the water. Furthermore, in a case where the air is sprayed on the electrical contacts, the cleaning apparatus can dry the electrical contacts.

(Appendix 34)

The cleaning apparatus according to Appendix 34 is the cleaning apparatus in Appendix 32 or 33, further including a second rod-shaped member configured to be rotatable, and agitating members attached to the second rod-shaped member for agitating a liquid in the cleaning tank by rotating integrally with the second rod-shaped member, wherein the plurality of mesh plates have respective through holes through which the second rod-shaped member passes.

The cleaning apparatus according to Appendix 34 can agitate the liquid in the cleaning tank.

(Appendix 35)

The cleaning apparatus according to Appendix 35 is the cleaning apparatus in any one of Appendices 29 to 34, further including a fan for sending air to the holding member, and a heater for heating the air to be sent to the holding member.

In the cleaning apparatus according to Appendix 35, the fan can supply the air heated by the heater to the holding member.

(Appendix 36)

The cleaning apparatus according to Appendix 36 is the cleaning apparatus in Appendix 35, further including a thermometer for measuring a temperature of the air in the cleaning tank, and a temperature regulator for controlling the heater based on the temperature measured by the thermometer.

In the cleaning apparatus according to Appendix 36, the fan can adjust the temperature of the air to be supplied to the holding member to a predetermined temperature.

(Appendix 37)

The cleaning apparatus according to Appendix 37 is the cleaning apparatus in Appendix 36 dependent on Appendix 32, including an air inlet for supplying the air into the cleaning tank, an air outlet for discharging the air from an interior of the cleaning tank, a partition plate for partitioning the cleaning tank into a first chamber in which the carrier is arranged and a second chamber, and a first opening and a second opening that are formed in the partition plate, wherein the second chamber is a flow path from the first opening to the second opening, in which the heater is arranged, the first chamber communicates the air inlet with the air outlet not through the second chamber, the second opening is adjacent to the carrier, and the fan is configured to send, to the first opening, air in the first chamber and air sucked from outside the cleaning tank through the air inlet, so that the air in the first chamber and the air sucked from outside the cleaning tank through the air inlet are sent toward the holding member through the second opening.

According to the cleaning apparatus according to Appendix 37, the air flowing in the second chamber is heated, and is sent toward the holding member arranged in the first chamber. Then, the air after being sent toward the holding member is sent to the second chamber again. Therefore, a part of the air to be supplied to the second chamber is the heated air. Accordingly, the apparatus can supply high temperature air to the holding member while saving the energy for heating the air.

Although only some embodiments of the present invention have been described above, those skilled in the art will readily appreciate that various changes or improvements can be made to the exemplary embodiments without materially departing from the novel teaching and advantages of the present invention. Accordingly, all such changes or improvements are intended to be included within the technical scope of the present invention. The foregoing embodiments may be combined at will.

REFERENCE SIGNS LIST

30: Substrate holder
31: First holding member
32: Second holding member
50: Electrical contact
100: Cleaning apparatus
102: Rotation member
108: Pump
140: Drain pipe
144: Liquid nozzle
154: Air nozzle
166: Warm air device
200: Cleaning module
202: Case
204: Nozzle
220: Citric acid tank
400: Cleaning apparatus
408: Supply port
410: Discharge port
428: Pump
438: Air inlet
440: Air outlet
442: Fan
444: Heater
446: Partition plate
448: First opening
450: Second opening
460: Thermometer
462: Temperature regulator
466: First rod-shaped member
468: Nozzle
470: Second rod-shaped member
472: Agitating member
500: Carrier
504: Mesh plate
520: Cleaning tank
540: Citric acid tank
900: Waste liquid part
902: Liquid source
904: Air source
Wf: Substrate

What is claimed is:

1. A cleaning method for a substrate holder having electrical contacts for supplying electric power to a substrate by contacting the substrate to plate the substrate, the method comprising:

a cleaning step of cleaning the electrical contacts of the substrate holder with a citric acid aqueous solution.

2. The cleaning method according to claim 1, in which the substrate holder includes a first holding member having relay contacts configured to be electrically connected to an external power source, and a second holding member having the electrical contacts, the method comprising:

a separation step of separating the second holding member from the first holding member before the cleaning step, wherein the cleaning step cleans the second holding member without cleaning the first holding member.

3. The cleaning method according to claim 1, wherein a percent concentration of mass of citric acid in the citric acid aqueous solution is 2 to 30%.

4. The cleaning method according to claim 1, further comprising:

a rotation step of rotating a ring-shaped holding member having the electrical contacts in a circumferential direction, wherein the cleaning step includes a step of spraying the citric acid aqueous solution on the electrical contact during the rotation step.

5. The cleaning method according to claim 1, further comprising:

a first water cleaning step of cleaning the substrate holder with water before the cleaning step.

6. The cleaning method according to claim 1, wherein the cleaning step includes an immersion step of immersing, in the citric acid aqueous solution held in a cleaning tank, an entirety of a holding member having the electrical contacts, the holding member being a member forming at least part of the substrate holder.

7. The cleaning method according to claim 6, further comprising:

a first water cleaning step of immersing the entirety of the holding member in water held in the cleaning tank, before the cleaning step.

8. The cleaning method according to claim 1, further comprising:

a second water cleaning step of cleaning the substrate holder with the water after the cleaning step; and a drying step of drying the substrate holder after the second water cleaning step.

9. The cleaning method according to claim 8, wherein the drying step includes:

an air sending step of sending air from a fan to the substrate holder; and a heating step of heating the air to be sent to the substrate holder by a heater.

10. A cleaning apparatus, comprising:

a rotation member for holding a ring-shaped holding member that holds a substrate for plating and has electrical contacts brought into contact with the substrate;

an actuator for rotating the rotation member to rotate the holding member in a circumferential direction; and a cleaning module for cleaning, with a citric acid aqueous solution, the holding member rotated by the rotation member.

11. The cleaning apparatus according to claim 10, wherein the holding member is a second holding member having the electrical contacts, and a substrate holder includes a first holding member having relay contacts configured to be electrically connected to an external power source, and the second holding member.

12. The cleaning apparatus according to claim 10, wherein the cleaning module has a nozzle for spraying the citric acid aqueous solution on the holding member.

13. The cleaning apparatus according to claim 10, wherein the cleaning module includes a case holding the citric acid aqueous solution, and a part of the holding member is configured to be immersed in the citric acid aqueous solution held in the case.

14. The cleaning apparatus according to claim 10, further comprising:

a warm air device for sending warm air toward the holding member.

15. A cleaning apparatus for a holding member that has electrical contacts and is a member forming at least part of a substrate holder, the cleaning apparatus comprising:

a cleaning tank for holding a citric acid aqueous solution therein and immersing the holding member in the citric acid aqueous solution.

16. The cleaning apparatus according to claim 15, wherein the substrate holder includes a first holding member having relay contacts configured to be electrically connected to an external power source, and a second holding member having the electrical contacts, and the holding member is the second holding member.

17. The cleaning apparatus according to claim 15, comprising:

a carrier accommodated in the cleaning tank, wherein the carrier includes a plurality of mesh plates for supporting the holding member, the plurality of mesh plates being arranged in an up-down direction.

18. The cleaning apparatus according to claim 17, further comprising:

a first rod-shaped member configured to be rotatable; and nozzles for spraying the citric acid aqueous solution, water, or air on the electrical contacts, the nozzles being attached to the first rod-shaped member and being rotatable integrally with the first rod-shaped member, wherein the plurality of mesh plates have respective through holes through which the first rod-shaped member passes.

19. The cleaning apparatus according to claim 17, further comprising:

a second rod-shaped member configured to be rotatable; and agitating members attached to the second rod-shaped member for agitating a liquid in the cleaning tank by rotating integrally with the second rod-shaped member, wherein the plurality of mesh plates have respective through holes through which the second rod-shaped member passes.

20. The cleaning apparatus according to claim 15, further comprising:

a fan for sending air to the holding member; and a heater for heating the air to be sent to the holding member.

* * * * *